US007393423B2

(12) United States Patent
Liu

(10) Patent No.: US 7,393,423 B2
(45) Date of Patent: Jul. 1, 2008

(54) USE OF ALUMINUM IN PERFORATING AND STIMULATING A SUBTERRANEAN FORMATION AND OTHER ENGINEERING APPLICATIONS

(75) Inventor: Liqing Liu, Calgary (CA)

(73) Assignee: Geodynamics, Inc., Millsap, TX (US)

( * ) Notice: Subject to any disclaimer, the term of this patent is extended or adjusted under 35 U.S.C. 154(b) by 0 days.

(21) Appl. No.: 09/923,368

(22) Filed: Aug. 8, 2001

(65) Prior Publication Data

US 2003/0037692 A1 Feb. 27, 2003

(51) Int. Cl.
*C06B 33/08* (2006.01)

(52) U.S. Cl. ..... 149/38; 149/108.2

(58) Field of Classification Search ..... 102/302, 102/341, 364; 149/37, 108.2, 38, 43
See application file for complete search history.

(56) References Cited

U.S. PATENT DOCUMENTS 4,372,213 A * 2/1983 Rozner et al. ..... 102/301
4,816,194 A * 3/1989 Katayama et al. ..... 423/213 X
5,212,343 A * 5/1993 Brupbacher et al. ..... 102/323
5,411,615 A * 5/1995 Sumrail et al. ..... 149/47
5,773,750 A * 6/1998 Jae et al. ..... 102/302
6,354,220 B1 * 3/2002 Graham et al. ..... 102/374

* cited by examiner

*Primary Examiner*—Stephen M Johnson
(74) *Attorney, Agent, or Firm*—David W. Carstens; Carstens & Cahoon, LLP

(57) ABSTRACT

A chemical reaction between molten aluminum and an oxygen carrier such as water to do useful work is disclosed, and in particular two chemical methods to obtain aluminum in its molten state. One is to detonate a HE/Al mixture with surplus Al in stoichiometry, and the other is to use an oxidizer/Al mixture with surplus Al in stoichiometry. Additionally, there is a physical method of shocking and heating Al using high temperature reaction products. The produced Al in its liquid form is forced to react with an oxygen carrying liquid (e.g. water), giving off heat and releasing hydrogen gas or other gaseous material. A water solution of some oxygen-rich chemicals (e.g. ammonium nitrate) can be advantageously used in place of water. A shaped charge is also disclosed having a liner that contains aluminum, propelled by a high explosive such as RDX or its mixture with aluminum powder. Some aluminum in its molten state is projected into the perforation and forced to react with water that also enters the perforation, creating another explosion, fracturing the crushed zone of the perforation and initializing cracks. Another shaped charge is shown having a liner of energetic material such as a mixture of aluminum powder and a metal oxide. Upon detonation, the collapsed liner carries kinetic and thermal energy. Also shown are methods to build and to detonate or fire explosive devices in an oxygen carrying liquid (e.g. water) to perforate and stimulate a hydrocarbon-bearing formation.

6 Claims, 17 Drawing Sheets

| Equation Number | Chemical Equation | Remarks |
|---|---|---|
| EQ 1 | $2\,Al + 3H_2O \rightarrow Al_2O_3 + 3H_2 + 946.2$ (KJ/mol) | Explosive event, hydrogen gas produced |
| EQ 2 | $2Al + 3CuO \rightarrow Al_2O_3 + 3Cu + 1203.0$ (KJ/mol) | Non-explosive event, no gaseous product |
| EQ 3 | $C_3H_6O_6N_6 \rightarrow 0.77CO_2 + 2.23CO + 2.23H_2O + 0.77H_2 + 3N_2 + 1145.76$ (KJ/mol) | RDX decomposition by detonation |
| EQ 4 | $2Al + 3CO_2 \rightarrow Al_2O_3 + 3CO + 820.6$ (KJ/mol) | $CO_2$ as a detonation product |
| EQ 5 | $2Al + 0.77CO_2 + 2.23H_2O \rightarrow Al_2O_3 + 0.77CO + 2.23H_2 + 914.0$ (KJ/mol) | Complete reaction between RDX detonation products and Al |
| EQ 6 | $xAl + 0.385xCO2 + 1.115xH_2O \rightarrow 0.5xAl_2O_3 + 0.385xCO + 1.115xH_2 + 457.0x$ (KJ/mol) | Complete reaction between RDX detonation products and x moles of Al, $0<=x<=2$ |
| EQ 7 | $C_3H_6O_6N_6 + xAl \rightarrow (0.77-0.385x)CO_2 + (2.23+0.385x)CO + (2.23-1.115x)H_2O + (0.77+1.115x)H_2 + 3N_2 + 0.5xAl_2O_3 + (1145.76+457.0x)$ (KJ/mol) | Complete reaction between 1 mole of RDX and $x$ moles of Al, $0<=x<=2$ |
| EQ 8 | $C_3H_6O_6N_6 + xAl \rightarrow 3CO + 3H_2O + 3N_2 + Al_2O_3 + x\,Al + 2060.0$ (KJ/mol) | RDX/Al mixture to produce Al in molten state, $x=>2$ |
| EQ 9 | $2Al + 3NH_4NO_3 \rightarrow Al_2O_3 + 6H_2O + 3N_2 + 2023.43$ (KJ/mol) | AN dissolved in water to increase reactivity and to decrease Al temperature for complete chemical reaction |
| EQ 10 | $3CuO + x\,Al \rightarrow Al_2O_3 + 3CuO + (x-2)Al + 1024.0$ (KJ/mol) | CuO/Al mixture to produce Al in molten state, $x=>2$ |
| EQ 11 | $Fe_2O_3 + 2Al \rightarrow Al_2O_3 + 2Fe + 846.0$ (KJ/mol) | Thermite reaction, mixture used to produce Al in molten state when Al is surplus in stoichiometry |

Fig. 1

| Equation Number | Chemical Equation | Remarks |
|---|---|---|
| EQ 1 | $2\,Al + 3H_2O \rightarrow Al_2O_3 + 3H_2 + 946.2$ (KJ/mol) | Explosive event, hydrogen gas produced |
| EQ 2 | $2Al + 3CuO \rightarrow Al_2O_3 + 3Cu + 1203.0$ (KJ/mol) | Non-explosive event, no gaseous product |
| EQ 3 | $C_3H_6O_6N_6 \rightarrow 0.77CO_2 + 2.23CO + 2.23H_2O + 0.77H_2 + 3N_2 + 1145.76$ (KJ/mol) | RDX decomposition by detonation |
| EQ 4 | $2Al + 3CO_2 \rightarrow Al_2O_3 + 3CO + 820.6$ (KJ/mol) | $CO_2$ as a detonation product |
| EQ 5 | $2Al + 0.77CO_2 + 2.23H_2O \rightarrow Al_2O_3 + 0.77CO + 2.23H_2 + 914.0$ (KJ/mol) | Complete reaction between RDX detonation products and Al |
| EQ 6 | $xAl + 0.385xCO2 + 1.115xH_2O \rightarrow 0.5xAl_2O_3 + 0.385xCO + 1.115xH_2 + 457.0x$ (KJ/mol) | Complete reaction between RDX detonation products and x moles of Al, $0<=x<=2$ |
| EQ 7 | $C_3H_6O_6N_6 + xAl \rightarrow (0.77-0.385x)CO_2 + (2.23 + 0.385x)CO + (2.23-1.115x)H_2O + (0.77 + 1.115x)H_2 + 3N_2 + 0.5xAl_2O_3 + (1145.76 + 457.0x)$ (KJ/mol) | Complete reaction between 1 mole of RDX and $x$ moles of Al, $0<=x<=2$ |
| EQ 8 | $C_3H_6O_6N_6 + xAl \rightarrow 3CO + 3H_2O + 3N_2 + Al_2O_3 + x\,Al + 2060.0$ (KJ/mol) | RDX/Al mixture to produce Al in molten state, $x=>2$ |
| EQ 9 | $2Al + 3NH_4NO_3 \rightarrow Al_2O_3 + 6H_2O + 3N_2 + 2023.43$ (KJ/mol) | AN dissolved in water to increase reactivity and to decrease Al temperature for complete chemical reaction |
| EQ 10 | $3CuO + x\,Al \rightarrow Al_2O_3 + 3CuO + (x-2)Al + 1024.0$ (KJ/mol) | CuO/Al mixture to produce Al in molten state, $x=>2$ |
| EQ 11 | $Fe_2O_3 + 2Al \rightarrow Al_2O_3 + 2Fe + 846.0$ (KJ/mol) | Thermite reaction, mixture used to produce Al in molten state when Al is surplus in stoichiometry |

Fig. 3

| Name of Oxygen Carrier | Molecular Formula | Oxygen Balance | Solubility in Water | Decomp. Temp. | Remarks |
|---|---|---|---|---|---|
| Sodium Nitrate | $NaNO_3$ | 47% ($Na_2O$, $N_2$) | 84.5 g/100 ml (20°C) | 380°C | Used as oxidizer in propellant, commercial explosives and black powder |
| Potassium Nitrate | $KNO_3$ | 39.6% ($K_2O$, $N_2$) | 38.5 g/100 ml (25°C) | 400°C | Used in pyrotechnics, commercial explosives, black powder, propellants and matches |
| Barium Nitrate | $Ba(NO_3)_2$ | 30.6% ($BaO$, $N_2$) | 8.7 g/100 ml (20°C) | 800°C | Used as oxidizer in propellants and pyrotechnics |
| Ammonium Nitrate | $NH_4NO_3$ | 20% ($H_2O$, $N_2$) | 192 g/100ml (20°C) | 210°C | Well-known fertilizer. Used in propellants and commercial explosives |
| Lithium Perchlorate, LP | $LiClO_4$ | 60.2% (LiCl) | 59.7 g/100ml (25°C) | 400°C | Used as oxidizer in rocket and missile propellant |
| Potassium Perchlorate | $KClO_4$ | 46.19% (KCl) | 18.2 g/100ml (100°C) | 530°C | Used as oxidizer in rocket propellant and in explosives |
| Strontium Perchlorate | $Sr(ClO_4)_2$ | 44.64% (SrCl) | 309.7 g/100ml (25°C) | 477°C | Used as oxidizer in propellants |
| Ammonium Perchlorate | $NH_4ClO_4$ | 34.04% | 20 g/100ml (25°C) | 200~300°C (low temperature decomposition) | Predominantly used as oxidizer in solid propellants for missiles and rockets |
| Potassium Chlorate | $KClO_3$ | 39.17% | 56.2 g/100ml (100°C) | 400°C | Used with fuel to make explosives, also used in pyrotechnics and match head |
| Sodium Chlorate | $NaClO_3$ | 45.10% | 100 g/100ml (20°C) | melting point 248°C | Moisture absorbing, not very often used in explosives |

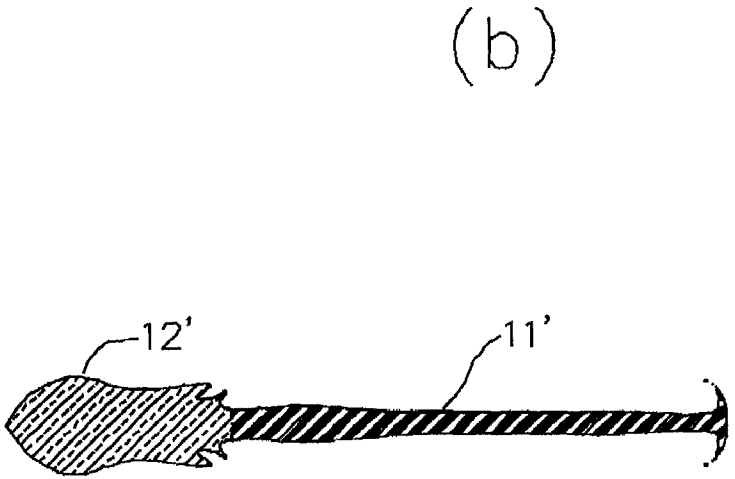
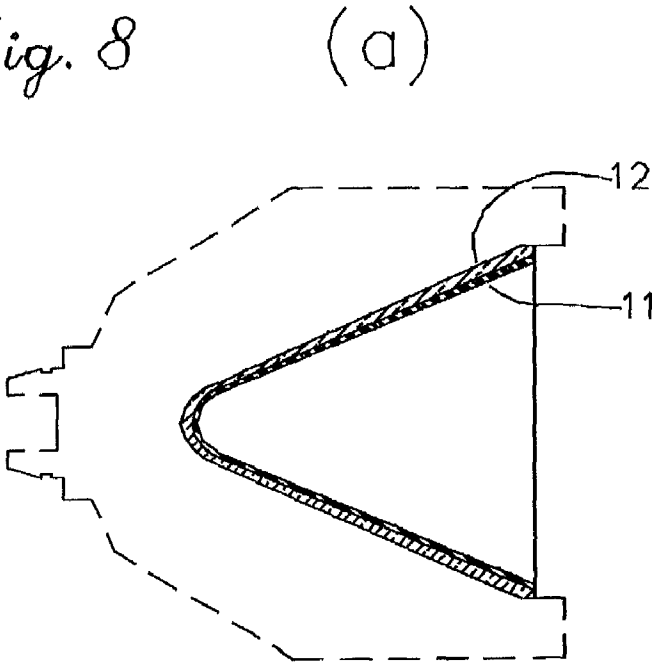
Fig. 8

USE OF ALUMINUM IN PERFORATING AND STIMULATING A SUBTERRANEAN FORMATION AND OTHER ENGINEERING APPLICATIONS

FIELD OF THE INVENTION

The present invention relates to the use of aluminum in general, and in particular to the chemical reaction between molten aluminum and an oxygen carrier such as water to do useful work in engineering.

BACKGROUND OF THE INVENTION

Aluminum ("Al"), the most abundant metallic element in the earth's crust, is a light weight, silver metal. Its atomic weight is 26.9815, and its specific gravity is 2.7. The element melts at 660° C. and boils at 2467° C. In today's explosives and ordnance industries, aluminum is used in its powder form in explosives and propellants due to the high heat value it generates when it reacts with oxygen. The heat released by oxidizing 1 gram of aluminum into aluminum oxide is 30.95 KJ, compared to the detonation heat of some most often used high explosives, for example, the tested detonation heat of RDX (Hexogen, Cyclotrimethylenetrinitramine) is 6.32 KJ/gram, and that of HMX (Octogen, Cyclotetramethylenetetranitramine) is 6.19 KJ/gram. Aluminum-oxygen reactions are widely used in metallurgy, fireworks, metal welding and in various other industries. When aluminum powder is mixed with a main explosive such as RDX, TNT (Trinitrotoluene), HMX or ANFO (Ammonium Nitrate Fuel Oil, an explosive used in rock blasting), it reacts with the detonation products from the main explosives such as $H_2O$ and $CO_2$, giving off extra heat to do useful work. The addition of aluminum powder in propellants increases the heat generated by combustion of a propellant and helps to stabilize the combustion process.

The present invention uses aluminum's reactivity in its molten form with some commonly seen oxygen-carrying chemicals like water or metal oxides. When Al is heated to above its melting point (660° C.), it reacts with water and gives off a large amount of energy. In such a reaction molten aluminum is fuel, and water functions as an oxidizer. Such a reaction proves to be a hazard in the aluminum casting industry. Known as steam explosion, it is a leading cause of fatalities and serious injuries among workers and of property damage in the metal-casting industry worldwide. It has been reported that from 1980 through 1995, the aluminum industry experienced several hundred explosions during casting operations. Three devastating explosions occurred in 1986 alone. Technologies have been developed to suppress such reactions from happening in the workplace and will not be discussed here. The present invention is concerned with the exploitation of such a reaction to do useful work in engineering. The intentional use of aluminum-water reaction for engineering purposes is rarely seen in today's industries. However, there are some patents that involve the use of such a reaction. For example, U.S. Pat. Nos. 4,280,409 and 4,372,213 to Rozner et al. disclose a molten metal-liquid explosive device and method. The patents teach the use of a pyrotechnic mixture such as a metal-oxidizer mixture that upon ignition heats a solid metal liner that in turn reacts with water to create an explosion event.

There are some patents concerning the use of the aluminum-water reaction to launch projectiles in the ordnance industry. U.S. Pat. No. 5,052,272 to Lee discloses the use of aluminum powder/water reaction to generate hydrogen gas and use it to propel projectiles. U.S. Pat. Nos. 5,712,442 and 5,789,696 to Lee and Ford describe the use of an aluminum (or aluminum-lithium, aluminum-magnesium) wire placed in water and be energized by electrical energy, reacting with water to generate hydrogen gas and to launch a projectile.

Recently, researchers at Oak Ridge National Laboratory in the United States found that the aluminum-water mixture can be used as a propellant to replace commonly used gunpowder. According to Dr. Taleyarkhan, the ORNL program manager, when aluminum mixes with water at high temperatures, the aluminum combines with the oxygen atoms in the water, releasing hydrogen and a great deal of energy, potentially four times greater than TNT. The aluminum-water mixture has been used as a new propellant for a specially made gun by the ORNL. The speed of the bullet launched by this gun is adjustable by controlling the strength of the reaction that launches the bullet, turning from deadly force into minor injury and saving lives. The new weapon fueled by aluminum-water mixture is said to be very suitable for law enforcement and defense, as disclosed in U.S. Pat. No. 6,142,056 to Taleyarkhan.

U.S. Pat. No. 5,859,383 to Davison et al. discloses a method to construct an explosive device such as a shaped charge for oil well casing perforation. The device uses energetic, electrically activated reactive blends such as an aluminum-water blend in place of high explosives, and the said reactive blends are activated by inputting electric energy through electric leads. According to the inventors of that patent, the electrically activated reactive composites such as an aluminum-water blend are potentially safe, energetic, environmentally benign alternatives to conventional explosives. Practical devices will contain filaments, foils, or sintered particles with dimensions of approximately 10 microns. They will be activated by electrical pulses produced by capacitors or by generators driven rapidly rotating devices.

In the oil and gas industry, an explosive device called a shaped charge or oil well perforator is used to establish a communication channel between the oil well and a hydrocarbon bearing formation. Typically, the device comprises three parts, namely a machined steel case, a generally cone-shaped liner and a certain amount of explosives sandwiched between the case and the liner. The liner turns into a high velocity metal jet upon detonation of the explosives, penetrating through the steel casing of the oil well, the concrete lining and into the formation. The perforation created in such a manner bears a layer of material hardened by the perforating process. Often called a "crushed zone", this layer hinders the flow of hydrocarbons into the oil well. Its permeability is much lower than that of the formation in its virgin state. To improve the oil flow, the crushed zone needs to be broken down using different stimulation techniques, including acidizing, hydraulic fracturing and fracturing using explosives or propellants.

Well stimulation using explosives has a long history. According to Watson, S. C. et al., as early as 1864, E. L. Roberts applied for a patent for increasing oil well productiveness with gun-powder explosions (U.S. Pat. No. 47,485, 1865, details unavailable). The patent also includes the use of NG (nitro-glycerine) because its velocity of detonation was 5~10 times faster, and its shattering effect was much greater, allowing the creation of more fissures through which the oil flowed into the well. Another purpose of explosives stimulation is to remove the paraffin that would clog the perforations after the well is put into production for some time. The heat generated by the detonation of explosives (or the combustion of propellants) melts the paraffin, removes it and cleans the perforations, increasing production.

A major problem with explosives stimulation is the shattering effects on the well. Due to the high detonation velocity and high percentage of shock wave energy associated with high explosives, a great area is crushed and sloughs into the well. Therefore, it generally needs lengthy cleanout time after the shot to resume production. According to Stoller, H. M., explosive fracturing creates a highly fractured region around the well bore; the gas pressure extends a few of these fractures further into the reservoir. The extremely high pressure results in permanent rock compaction and a very low permeability barrier at the well bore. Due to the shattering effects of an explosive event, explosive fracturing is suitable for uncased wells only. In practical applications, it has been realized that the highly dynamic process of explosive stimulation has an overly rapid pressure rise time, and too much shock energy is transmitted into the formation, creating a large quantity of small cracks.

The other method commonly used in well stimulation is hydraulic fracturing. Compared to the highly dynamic explosive fracturing, the loading process of hydraulic fracturing is much slower and can be regarded as a quasi-static process. It needs lengthy setup time and the operating cost is high. Nevertheless, it generally creates only a single crack into the formation from a perforation. Based on a comparison of the advantages and disadvantages between explosive stimulation and hydraulic fracturing, it is apparent that a process that can be used to create a network of multiple fractures with an operating cost similar to that of explosive stimulation would be most desirable and such a process would be associated with the use of propellants. It is assumed that such a network of multiple fractures is more likely to intersect with far-field natural fractures than the fractures created by explosive or hydraulic fracturing processes.

The original well stimulation technology that uses propellant gas generators to create and extend multiple fractures has been studied and applied in engineering with substantial success. The technology has many names in practical applications, such as tailored pulsed loading, controlled pulse pressurization, high energy gas fracturing, controlled pulse fracturing and dynamic gas pulse loading. When used in oil well stimulation, the basic requirements for the process and the propellant include:

1) The pressure generated by the combustion of propellant should be so that it exceeds the tensile strength but be lower than the compressive strength of the formation to be fractured. Also the pressure must be lower than the safety pressure of tubular goods, packers and valves;
2) The pressure rise time should allow it to create multiple fractures and to stay in zone but not at a rate in excess of the acceptable loading rate of the well equipment.
3) The generated gas has a volume big enough to extend the fracture to an effective length.

Propellant used in place of high explosives has been found to be the most suitable to create such a network of multiple fractures in the formation. There are numerous patents concerning the use of propellants in stimulating subterranean hydrocarbon bearing formations as well as the efforts to perforate and stimulate a formation in a single operation (to complete perforating and stimulating of a hydrocarbon bearing formation concurrently). Cited below are just some examples.

U.S. Pat. No. 5,775,426 to Snider et al. describes a method to use perforating charges and propellant stimulation simultaneously. Shaped charges are loaded in a perforating gun and a shell, sheath or sleeve of solid propellant material is used to cover the exterior of the gun. Upon detonation of the charges, the high velocity jets penetrate through the gun, the casing and into the formation. At the same time, the jets, high pressure and high temperature ignite the propellant. The high-pressure gas generated by the combustion of the propellant is forced to enter into the perforations created by the jets, creating multiple fractures from each perforation.

U.S. Pat. No. 4,253,523 to Isben discloses the use of shaped charges in a perforating gun which is filled with secondary explosives with lower detonation velocity. According to the inventor, upon detonation of the shaped charge in the gun, it penetrates into the formation, creating a perforation. The shock wave of that secondary explosive will follow the perforation and will continue through the constant diameter perforated cavity.

U.S. Pat. No. 4,391,337 to Ford et al. describes an integrated jet perforation and controlled propellant fracture device and method for enhancing production in oil and gas wells. The device is loaded with perforating charges and fuel packs. Upon detonation of the perforating charges, the fuel packs are ignited. Then the high-velocity penetrating jet is instantaneously followed by a high-pressure gas propellant such that geological fracturing initiated by the action of the penetrating jet is enhanced and propagated by the gas propellant.

U.S. Pat. No. 4,064,935 to Mohaupt provides a gas generating charge that is placed in the oil well bore and activated to generate a controlled surge of gas pressure-volume of a known magnitude-time profile and directed perpendicular to the side of the well bore to flush clogged material away from the well bore and open up clogged passages for the greater flow of the oil into the well bore without damaging the well.

U.S. Pat. No. 5,690,171 to Winch et al. describes a device comprising a pipe having a plurality of weakened portions and containing a propellant material. When the propellant is ignited it produces rapidly expanding gaseous combustion products that puncture the weakened portions of the pipe. The expanding gas fractures the surrounding formation, thereby stimulating the formation to production.

U.S. Pat. No. 5,355,802 to Petitjean describes a method to perforate and fracture a formation in a single operation. The method includes the use of propellant canisters and shaped charges in a perforating tool, and the proper procedures of igniting the propellant and detonating the shaped charges.

U.S. Pat. No. 5,551,344 to Couet et al. discloses the use of propellant or compressed gas along with a liquid column. Upon ignition of the propellant or the activation of the compressed gas, the high-pressure gas released drives the liquid into the formation to propagate the fracture.

U.S. Pat. No. 4,081,031 to Mohaupt describes the use of a chemical gas generating charge activated to provide a controlled surge of gas pressure-volume of a known magnitude-time characteristic and directed to flush away clogged material in the well-bore and open-up clogged passages for the greater flow of oil into well bore without damaging the well.

U.S. Pat. No. 4,683,951 to P. Pathak et al. discloses a method to enhance the effective permeability of subterranean hydrocarbon bearing formations by proceeding the surfactant fluid injection step with creation of multiple formation fractures using tailored pressure pulses generated by propellant canisters disposed in the injection well. Fluid injectivity rates are increased by subsequent fracture extensions provided by repeated steps of generating high-pressure gas pulses at selected intervals.

U.S. Pat. No. 3,747,679 describes the use of a liquid explosive that has a small critical diameter, is safe to handle to fracture well formation for enhancing well productivity.

U.S. Pat. No. 3,797,391 to Cammarata et al. seems to show an example of the use of aluminum as shaped charge liner material in the purpose to project some liner material into the target upon collapse of the liner. Disclosed by Cammarata et al. is a multiple shaped charge bomlet having a plurality of shaped charges. Each charge has a bimetallic liner (the air side being the high density metal such as copper and the explosive side being the pyrophoric metal such as aluminum, magnesium, zirconium). The charges have the capability of penetrating hard structures and propelling incendiary particles through the perforations made in the target by the shaped charge jet. Since the referenced patent is used in an environment without the presence of water, the exothermic reaction of the incendiary particles should be between the said pyrophoric metal such as aluminum with oxygen in air, and obviously not with an oxygen carrying liquid like water.

Due to the relatively high cost associated with the use of a propellant in oil well stimulation, there have also been efforts to find a substitute for it. U.S. Pat. No. 5,083,615 to McLaughlin et al. discloses the use of aluminum alkyls to react with water within a confined space. The gas-generating chemical reaction can build up substantial pressure, and the pressure can be used to fracture rocks around a borehole, and hence stimulate water, oil or gas wells in tight rock formations. According to the inventors, the pressure can also be used to fracture coal seams for enhanced in-situ gasification or methane recovery. The aluminum alkyls are organo-metallic compounds of the general formula $AlR_3$, where R stands for a hydrocarbon radical. These compounds react violently with water to release heat and the hydrocarbon gas. Some aluminum alkyls are available commercially at low cost. However, the tendency of the aluminum alkyls to ignite spontaneously in air would make it very difficult to handle in practical applications, and the pressure increase in the order of 3000 psi (210 bars) seems to be too low to fracture most of the rock formations.

U.S. Pat. No. 4,739,832 to Jennings et al. teaches a method for increasing the permeability of a formation where high impulse fracturing device is used in combination with an inhibited acid. The inhibited acid is directed into a well bore contained in the formation. A two-stage high impulse device is then submerged within the acid. After the high impulse-fracturing device is ignited, activating the retarded acid by the heat generated; then the fractures in the formation are induced and simultaneously forcing said activated acid into the fractures.

SUMMARY OF THE INVENTION

Consequently, a first objective of the present invention is to exploit the large amount of energy generated by the oxidation of aluminum from an aluminum-water reaction (or the reaction of aluminum with other oxidizers such as a metal oxide) for engineering applications, an in particular to provide a method to rapidly, economically produce molten aluminum in its free form in large quantities. The molten aluminum should preferably be produced from an explosive detonation process or from a rapid combustion of a fuel-oxidizer mixture so that a "dual-explosion" can be created. The first explosion of such a "dual-explosion" is the detonation of the high explosives or the combustion of the fuel-oxidizer mixture, and the second explosion is the aluminum-water reaction. When such a "dual-explosion" is created in a medium such as water, steel casing or tubing, hydrocarbon bearing formation, rock stratum or concrete etc., the mechanical effects resulting from the first explosion will be greatly enhanced or improved by the second explosion. The mechanical effects in the medium can be the mechanical effects for which an explosive device is designed to achieve, which may include, but is not limited to, one or a combination of the following effects: pressure wave generation and propagation, pressurization and displacement of medium, target penetration and fracturing, crack initialization and propagation, medium disintegration, fragmentation and fragment movement, etc.

A second objective of the present invention is to increase the reactivity between molten aluminum and water so that the minimum temperature required for aluminum for a complete reaction to occur can be lowered and the energy output from the reaction can be increased.

A third objective of the present invention is to make a shaped charge so that it can project some aluminum in molten state into the perforation created by the shaped charge jet. The molten aluminum is then forced to react with water to create an explosion locally within the perforation, fracturing the crushed zone of the perforation and initializing a multitude of cracks.

A fourth objective of the invention is to make a shaped charge that can have a liner made of energetic material. When the collapsed liner is projected toward a target, it carries not only kinetic energy transferred to it by the detonation of the explosives of the shaped charge, but also a substantial amount of thermal energy.

A fifth objective of the invention is to develop a system that uses capsule type shaped charges to concurrently perforate and stimulate a hydrocarbon bearing formation.

A sixth objective of the invention is to develop a system that uses an open-end shaped charge with a tubular perforating gun to concurrently perforate and stimulate a hydrocarbon bearing formation.

A seventh objective of the invention is to provide a method and device using the aluminum-water reaction to stimulate a perforated zone, or to revitalize an old production well, by cleaning the clogged perforations using the pressure and heat generated by the reaction.

An eighth objective of the invention is to provide a method and device to be used in drilled holes filled with water or water solution of some oxygen-rich reagents for rock blasting, pre-splitting, concrete structure blasting, cutting and demolition that can create two consecutive explosions and enhanced mechanical effects.

A ninth objective of the invention is to provide a method and device suitable for in situ gasification of a coal seam. The device should be detonated in the presence of water or a water solution of some oxygen-rich reagents contained in the said coal seam. The device then initializes and extends the cracks far into the coal seam upon its two consecutive explosions.

A tenth objective of the invention is to provide a method to make a torpedo suitable for defense applications. Unlike prior art torpedoes, it creates two consecutive explosions with much more energy output and enhanced mechanical effects when launched and set off underwater.

The above stated and other objectives of the present invention will become apparent upon study of the following detailed specification along with the disclosed drawings and tables.

BRIEF DESCRIPTION OF THE DRAWINGS

FIG. 1 is a table of the chemical reaction equations used and discussed in the text of this specification;

FIG. 3 tabulates commonly used water-soluble oxidizers (nitrates, chlorates and perchlorates) for mixing with Al powder to produce molten Al in a molten state, or to be dissolved in water to enhance Al—$H_2O$ reactivity;

FIGS. 8(*a*) and 8(*b*) show the collapsing process of a double-layer liner. By controlling the design parameters, all the material in the high-density layer 11 (airside) enters the jet 11' to penetrate a target and all that in the aluminum layer 12 (explosive side) enters the slug 12' to create an in-the-target explosion;

List of Reference Numerals in Figures

Figure 2:
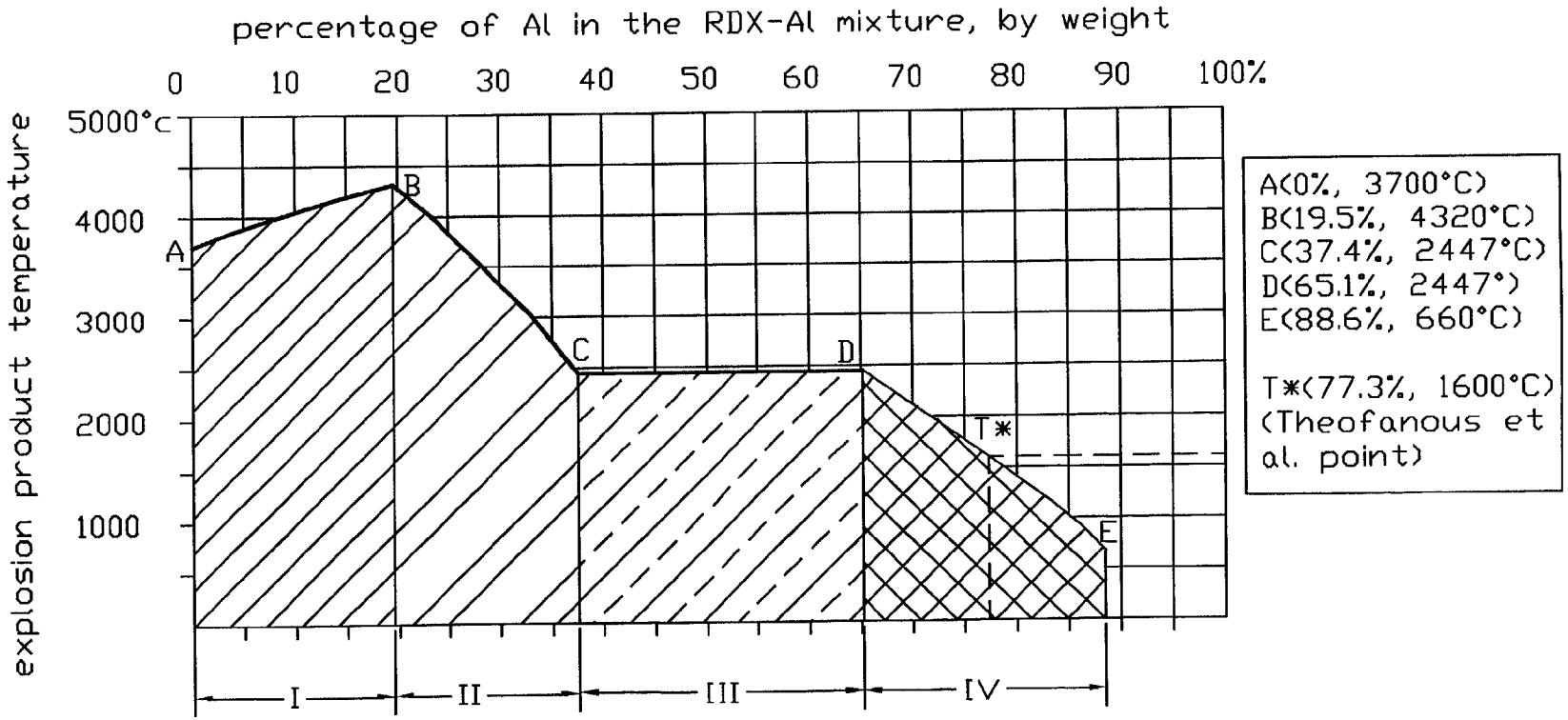
FIG. 2 plots the temperature of reaction products from a RDX/Al mixture as a function of Al content (by weight) in the mixture.

| | |
|---|---|
| 10 | Shaped charge liner |
| 11 | Airside layer of shaped charge liner |
| 11' | Airside layer of shaped charge liner collapsed to form a jet |
| 12 | Explosive side layer of shaped charge liner |
| 12' | Explosive side layer of shaped charge liner collapsed to form a slug |
| 15 | Isolating layer between liner 10 and explosive load 30 |
| 17 | Oil well casing plate |
| 18 | Entrance hole created by the shaped charge |
| 19 | Liner material spattered on the rim of the entrance hole |
| 20 | Shaped charge case |
| 30 | Shaped charge explosive load |
| 31 | Explosive layer embracing liner, having low or no Al content |
| 32 | Explosive layer embraced by case interior, having high Al |
| 40 | Detonating cord slot |
| 41 | Primer hole of the charge that is not drilled through |

-continued

| List of Reference Numerals in Figures | |
|---|---|
| 50 | Oil well casing |
| 60 | Concrete lining |
| 70 | Hydrocarbon bearing formation |
| 80 | Perforation created by the shaped charge jet |
| 90 | Crushed zone of the perforation |
| 100 | Molten aluminum projected into perforation |
| 110 | Water in the well/drillhole |
| 111, 112, 113 | Water in drillhole |
| 120 | A multitude of cracks created by reaction |
| 130 | Lower packer used to isolate the zone to be treated |
| 140 | Tubular perforating gun |
| 150 | Charge holder |
| 160 | Detonating cord |
| 170 | Open-end type shaped charge to perforate and stimulate |
| 171 | Open-ended type shaped charge |
| 180 | Detonator |
| 190 | Top end of perforating gun |
| 200 | Lower end of perforating gun |
| 210 | Weakened portion in the perforating gun (scallop) |
| 220 | Sealing cap of charge |
| 230 | Sealing O-ring of charge |
| 240 | Retainer ring of charge |
| 250 | Carrier strip |
| 260 | Connecting threads |
| 270 | Separate molten Al producing unit |
| 275 | Molten Al producing unit placed outside a perforating gun |
| 280 | Capsule type shaped charge to perforate and stimulate |
| 290 | Capsule type charge carrier |
| 310 | Container |
| 320 | Initiation means |
| 321, 322 | Initiation means |
| 330 | A mixture to produce a dual-explosion upon actuation |
| 331, 332 | A mixture to produce a dual-explosion upon actuation |
| 340 | Hanging means of containers |
| 350 | Initiation energy transmitting means |
| 351, 352, 353 | Initiation energy transmitting means |
| 360 | Drillhole |
| 361, 362, 363 | Drillholes |
| 370 | Stemming material on top of drillhole |
| 371, 372, 373 | Stemming material on top of drillhole |
| 380 | Free face on top of rock stratum |
| 390 | Free face on side of rock stratum |
| 400 | Rock stratum |

DESCRIPTION OF PREFERRED EMBODIMENTS OF INVENTION

TABLE OF CONTENTS

I. Methods to Produce Al in Molten State
- Embodiment 1: by Detonation of an HE/Al Mixture
- Embodiment 2: by Combustion or Detonation of an Oxidizer/Al Mixture
- Embodiment 3: by Shocking/Heating Al II. Method to Increase Al—$H_2O$ Reactivity III. Classes of Further Embodiments of the Present Invention
- Class 1: Shaped Charge to Create an Explosion in Target
- Class 2: Shaped Charge Liner Made of Al-based Energetic Material
- Class 3: Capsule Type Shaped Charge to Perforate and Stimulate
- Class 4: Shaped Charge to Perforate and Stimulate with a Perforating Gun
- Class 5: Stimulating Method and Devices
- Class 6: Other Engineering Applications

I. Methods to Produce Aluminum in Molten State

It is known that aluminum in its molten state reacts violently with water to form aluminum oxide, generating a substantial amount of heat and releasing a large volume of hydrogen gas. The reaction equation of this process is shown as EQ1 in FIG. 1. It is also well-known that aluminum can be used to react with oxygen carriers such as copper oxide (CuO) or triiron tetroxide ($Fe_3O_4$) in the purpose to obtain a large amount of heat usable for some engineering processes such as welding or metallurgy. The chemical reaction equation between aluminum and copper oxide (CuO) is shown as EQ2 in FIG. 1. Although the chemical processes of EQ1 and EQ2 seem to be similar to each other in that they are oxidation-reduction reactions, a comparison will show some distinct differences. The Al—$H_2O$ reaction (EQ1) releases a significant amount of hydrogen gas while the aluminum-copper oxide reaction (EQ2) does not yield any gaseous product. Consequently, the Al—$H_2O$ reaction is an explosive event in that it not only generates heat but also releases gaseous products, while the aluminum-copper oxide reaction is not. This is why when the aluminum-water reaction occurs especially when a large quantity of aluminum is involved, it can be very destructive, causing injuries, fatalities and extensive property damage as might happen in an accident in an aluminum-casting foundry. As an example of the power and destructiveness of this reaction, a lot of destruction in the Chernobyl nuclear reactor disaster in 1986 was from molten aluminum reacting with water that was used as a coolant, according to Dr. Taleyarkhan of ORNL.

The huge amount of energy released from the Al—$H_2O$ reaction should be harnessed and be used to do useful work. To exploit the engineering use of this reaction, the basic problem is how to achieve aluminum in its molten state in large quantities. U.S. Pat. Nos. 4,280,409 and 4,372,213 to Rozner et al. describe the use of pyrotechnic reactions to heat solid metal (used as container for pyrotechnic mixture) and force the molten metal to react with water. This method may have limited heat transfer efficiency due to the fact that a piece of solid metal has only limited surface area that comes in contact with the pyrotechnic material and the time duration available for such a heat transfer process is very limited once the device is actuated.

In U.S. Pat. No. 5,859,383 to Davison et al. there is disclosed a method of using electric energy to heat the aluminum wires and force the wires to react with water. According to the inventors, the heat needed to activate the reaction is at the level of 1~10 KJ/gram of reactive mixture. Such a high level of initiation energy would require the use of expensive auxiliaries such as energy transmitting cables, electrical energy generating and storing devices. Such requirements would render the method and process uneconomical and not practical for engineering applications. Similar actuation methods and devices by electrical power can be found in U.S. Pat. Nos. 5,052,272, 5,712,442 and 5,789,696, as referenced previously.

In the present invention, three novel embodiments to effectively, conveniently and economically generate aluminum in its molten state in large quantities for engineering use are disclosed. The molten aluminum produced is normally a "by-product" from a main detonation or combustion event designed to create some required mechanical effects. The method in the first embodiment is to detonate a HE/Al mixture in which the aluminum powder is surplus in stoichiometry. The method in the second embodiment is to initiate an oxidizer/Al mixture in which the aluminum powder is surplus in stoichiometry. The reaction of the mixture may be a detonation or combustion. The method in the third embodiment is to shock Al with an explosive detonation and then heat it with the detonation products. Since the production of molten state aluminum is always associated with the detonation or rapid combustion of an explosive device, the use of the present invention creates a "dual-explosion". The first explosion is from the reaction of the explosive device, and the second being the Al—$H_2O$ reaction. The above embodiments are described below.

Embodiment 1 by Detonation of an HE/Al Mixture

When aluminum powder is mixed with a high explosive, upon detonation of the mixture there are two energy sources to heat the reaction products to a high temperature. One is the detonation heat, or the heat released by the detonation decomposition of the high explosive itself; the other is that from the reactions between the detonation products of the said high explosive and the aluminum powder. The high explosive used in the mixture is not necessarily rich in oxygen. As a matter of fact, for some commonly used high explosives like RDX, HMX and TNT, they have negative values in oxygen balance.

For high explosives, the temperature of its detonation products is normally in the order of 3000~4000° C. In terms of heat generated by the detonation of explosives and the heat needed to melt aluminum, the heat of detonation for typical high explosives is in the order of 4~6 KJ/gram and that the heat needed to melt 1 gram of aluminum is only 0.396 KJ. This means that the heat generated by 1 unit weight of high explosives should be able to melt a substantial amount of aluminum if the heat is effectively transferred to the latter. In the explosives and ordnance industries, it is not new to add light metal powders like aluminum or magnesium powder to high explosives in the purpose to increase the heat value of the explosives. Generally called "aluminized explosives" in the art when aluminum powder is used, the extra heat value obtained from this category of explosives is from the reaction between aluminum powder with the detonation products of the explosives. Therefore, the aluminum content in the mixture is calculated to maximize the heat that would be generated. In other words, in the prior art of mixing "aluminized explosives", there is no intent to produce aluminum in its free form Al in molten state, and there is no intent to use the Al—$H_2O$ reaction to do useful work.

U.S. Pat. No. 4,376,083 to Ulsteen references some well-known "aluminized explosives" used in the defense industry, such as those known by the names like Torpex, H-6, HBX-1, HBX-3, etc. One grade of the "aluminized explosives", the TNT/RDX/Al (in the compositions of 60% TNT, 24% RDX and 16% Al, or 60% TNT, 20% RDX and 20% Al) was used very early in torpedoes and maritime bombs for increased power. The aluminum powder mixed in this kind of explosives will all be consumed in the reactions with the detonation products of the high explosives, there will be no aluminum in free form in reaction products. In other words, to utilize the Al—$H_2O$ reaction, the aluminum content in the mentioned explosives is not high enough. Except for torpedoes, "aluminized explosives" in the prior art are normally not intended for use in presence of water.

With the method of the present invention, any known explosive can be used to produce molten aluminum by mixing it with aluminum powder. Examples are, but not limited to, RDX (Hexogen, Cyclotrimethylenetrinitramine), HMX (Octogen, Cyclotetramethylenetetranitramine), TNT (Trinitrotoluene), PETN (Pentaerythritol tetranitrate), Picric Acid (2,4,6-trinitrophenol), CE (Tetryl), PYX, HNS (Hexanitrostibene) and some ammonium nitrate based explosives used in rock blasting like ANFO (ammonium nitrate fuel oil) and emulsion explosives. In this method, to produce aluminum in molten state using a high explosive as an energy source, the high explosive is mixed with an amount of aluminum powder that is surplus in stoichiometry. The stoichiometry point for a high explosive-aluminum mixture can be determined assuming complete reaction between aluminum and the detonation products of the said high explosive such as $H_2O$ and $CO_2$. In the method of the present invention to produce aluminum in molten state, there are two phases of chemical reactions involved corresponding to the two energy sources to heat the detonation products:

a) Detonation of the high explosive: Normally, the detonation is initiated by using a shock wave such as that generated by using a detonator, a detonating cord or a primer charge. Upon detonation of the explosive, the original chemical composition is disintegrated into detonation products, which are typically $H_2O$, $CO_2$, CO, C, $N_2$, $H_2$ for CHON explosives (explosives composed of carbon, hydrogen, oxygen and nitrogen), and release a large amount of thermal energy, heating the detonation products to very high temperature. As an example, the decomposition equation of RDX by detonation is listed as EQ3 in FIG. 1. In this phase, aluminum powder is not involved in the detonation reaction. Instead, it behaves like an inert material and a certain amount of the detonation heat is consumed in heating it to a high temperature. Therefore, explosives containing aluminum powder will have a slightly lower detonation velocity and brisance.

b) Reactions between aluminum powder and detonation products: As soon as the detonation products are formed, some of them react with the aluminum powder. Typical reactions for CHON explosives are the aluminum-water reaction (see EQ1, FIG. 1) and the aluminum-carbon dioxide ($CO_2$) reaction (see EQ4, FIG. 1). Both are exothermic reactions and they contribute more thermal energy to the chemical process and the temperature of the final reaction products is much higher than that of the detonation products without aluminum added. Aluminum also reacts with nitrogen gas ($N_2$) in the detonation products to form aluminum nitride (AlN), which is also an exothermic reaction. The reaction between aluminum and high explosive detonation products can even influence the detonation reaction zone of the high explosive. In a study by Lubyatinsky et al., the detonation reaction zone thickness of a mixture of RDX and aluminum was investigated and it was found to change from 0.34~0.58 mm corresponding to an aluminum content of 0~19%, compared to that of RDX/TNT 50/50, which had a thickness of 0.59 mm. As will be described, 19% of Al in an RDX/Al mixture is about the maximum amount of Al that can be consumed in the reactions between Al and detonation products of RDX. If the Al content is more than this, the thickness of the detonation reaction zone will be increased and the detonation velocity decreased.

From EQ3 in FIG. 1, it is seen that upon detonation of 1 mole of RDX, 0.77 Mole Of $CO_2$ and 2.23 moles of $H_2O$ are produced. Assume that aluminum powder only reacts with $CO_2$ and $H_2O$ in the detonation products and neglect the reaction between Al and $N_2$ for simplicity. The combined reaction equation between Al and $H_2O$ and $CO_2$ can be written as EQ5 in FIG. 1. Based on the above assumption and simplification, it is found that the detonation products from 1 mole of RDX can react completely with 2 moles of Al. This is equivalent to say that the mixture of 1 mole of RDX to react with up to 2 moles of Al will have no aluminum left over (not reacted) in the final reaction products.

The temperature of the final reaction products as a function of Al content can be calculated. Firstly, assume 1 mole of RDX is mixed with x moles of Al (0<=x=<2). EQ6 as seen in FIG. 1 is derived from EQ5, assuming x moles of Al. Accordingly, the complete reaction between 1 mole of RDX and x moles of Al (0<=x<=2) is described by EQ7. In this patent, the data and calculation results are used to demonstrate the basic concepts and approaches of the present invention only, they are not intended to limit the use of the invention or to endorse any data or method of calculation. As a matter of fact, the calculation results can vary significantly depending on the data source and method of calculation used.

Based on the total amount of heat generated from the said two phases of reactions and the heat capacities of the reaction products and aluminum, the temperature of the final detonation products along with surplus aluminum (if there is any) can be found. Results of a sample calculation of the RDX-aluminum mixture are plotted in FIG. 2. As shown in this figure, point A corresponds to pure RDX (Al content 0%), the temperature of detonation products is 3700° C. (in the calculations, 0° C. ambient temperature was assumed for simplicity). The temperature of the reaction products increases with the increase in Al content up to 19.5% at point B (corresponding to 1 mole of RDX versus 2 moles of Al), where the highest temperature of 4320° C. is obtained and point B is called the stoichiometry point. From point A to point B, zone I is defined. In this zone, all the Al material in the original RDX/Al mixture is consumed and there is no Al in its free state in the reaction products. This zone virtually shows how much Al is used to mix with RDX in the art to make "aluminized" RDX. As a result of increased aluminum use in this zone, more and more heat is generated and the reaction products have a much higher temperature. After the reaction, there is no surplus Al in free state to induce an Al—$H_2O$, even when the explosive device is actuated in presence of water.

Point B in FIG. 2 is the stoichiometry point at which all the Al material is consumed. When the Al content is further increased in the RDX/Al mixture, there will be more Al than that can be consumed in the reactions and the surplus Al is heated to a high temperature along with other reaction products. Assume that 1 mole of RDX is mixed with x moles of Al (x>2). As described above, in the mixture, 2 moles of Al will be consumed in reactions with the detonation products of 1 mole of RDX, leaving the rest or (x−2) moles of aluminum in its free form and be heated to a high temperature along with other reaction products. The total heat generated from the detonation of 1 mole of RDX plus that released by the reactions of 2 moles of aluminum with the detonation products (specifically 0.77 mole of $CO_2$ and 2.23 mole of $H_2O$) is 2060.0 KJ, the combined chemical reaction equation of 1 mole of RDX and x moles of Al (X>=2) is shown as EQ8 in FIG. 1. In FIG. 2, point C corresponds to a point where the said surplus Al is completely vaporized (Al content in the mixture is 37.4% by weight, and the temperature of the reaction products is 2447° C., the vaporization point of Al). The points B and C define zone II in which surplus Al is produced and it is in vapor form in the reaction products.

Beyond point C in FIG. 2, with the further increase in Al content, there is not enough heat to vaporize all the surplus Al in the reaction products. This trend continues till point D (Al content in the RDX/Al mixture is 65.1% by weight and the temperature of reaction products is 2447° C., all surplus Al in liquid form). Points C and D in the figure define zone III where vapor form and liquid form of surplus Al coexist in the reaction products. Although points C and D are shown to have the same temperature, energy carried by each grain of surplus Al is not the same. At point D, All surplus Al is in liquid form while in point C it is all in vapor form. Consequently, each gram of surplus Al at point C is more energetic than that at point D.

In FIG. 2, point E (88.6% Al content by weight in the RDX/Al mixture), temperature of surplus Al is 660° C. (melting point of Al) and it is all in liquid form. Points D to E in this figure define zone IV, where all the surplus Al is in liquid form with a temperature above the melting point but below the vaporization point of Al. Point E in this figure implies that with only 11.4 grams of RDX, the detonation heat along with the heat generated by the reactions between the detonation products with 2.77 grams (1 mole of RDX to 2 moles of Al) of Al would melt as much as 85.83 grams of Al. This number suggests that when a high explosive like RDX is used as an energy source to produce Al in molten state, the efficiency is high. The ratio by weight between RDX and produced Al in molten state at minimum temperature (melting point of 660° C.) is approximately 1 to 7.5. However, if the mixture with this high percentage of Al is uniformly mixed with the small amount of RDX, the detonation wave may not be able to propagate reliably in the mixture. A simple solution to this problem is to use a non-uniform structure, that is, to make an explosive charge in at least two layers, with one layer having a high percentage of RDX that can detonate steadily and the other layer having a high percentage of Al but may have a decreased velocity of detonation.

The said two phases of reactions, i.e., detonation of the high explosive and reactions between aluminum powder and the detonation products, are completed within micro seconds and virtually in the original space as was occupied by the high explosive-aluminum mixture. Then the detonation products along with the surplus aluminum in its molten state expand violently and rapidly into the surrounding medium. When this medium is water (the explosive device be detonated in water), the surplus Al in molten state is forced to interact with water, creating a new explosive event that can output even more energy than the said two phases of reactions.

According to some experimental studies, the temperature of molten Al is a critical factor for the Al—$H_2O$ interaction. If this temperature is not high enough, the interaction maybe only a physical event, involving intense intermixing and rapid thermal energy transfer between the molten Al and liquid water. Only when the Al temperature is above a critical value will the interaction turn chemical, i.e., the chemical reaction between molten Al and water be "ignited" and the "combustion" will be completed. Theofanous et al. studied the influence of aluminum temperature on the aluminum-water interaction. In their study, gram quantities of molten aluminum droplets at temperatures up to 1973° K are forced to interact with water under sustained pressure pulses of up to 40.8 Mpa in a hydrodynamic shock tube. After examining the morphology of the aluminum debris retrieved, three regimes of interactions were identified: an essential non-chemical "hydrodynamic regime" at low melt temperatures (<1400° C.) which resulted in a few aluminum fragments in the millimeter size range and/or a largely un-fragmented but highly convoluted aluminum mass; a regime of complete aluminum combustion at initial melt temperatures above about 1600° C. which converted almost all of the aluminum mass to a fine powder of oxidic particles in the one to ten microns range and an intermediate or "ignition" regime for melt temperatures in the range 1400~1600° C. with debris composed of both oxidic powder (10% to 40%) and metallic fragments ranging from hundreds of microns to millimeter sizes. According to this study, for a complete chemical reaction between Al and water to occur, a temperature of aluminum just above the melting point is not high enough; instead, it should preferably be higher than 1600° C. For an RDX/Al mixture, to output surplus Al at a temperature of 1600° C., the corresponding Al content by weight is 77.3%. This point will be termed the Theofanous et al. point in the specifications of the present invention, as indicated by point T* in FIG. 2. At this point, it is implied that with 22.7 grams of RDX, the detonation heat along with the heat generated from the reactions of 5.52 grams of aluminum with the detonation products would produce 71.78 grams of molten aluminum at a temperature of 1600° C., which will chemically and completely react with water on encountering it. The data cited here from the study by Theofanous et al. is not intended to limit the use of the present invention. Instead, it is in the purpose to specify the existence of such a point in aluminum temperature and a method to calculate the compositions of a high explosive/Al mixture. As a matter of fact, some other researchers like Rightly et al. reported that the temperature of large-scale molten Al to ignite underwater was as low as 1150° K. In the present invention, the actual temperature of Al produced for complete chemical reaction for a specific explosive device can be determined experimentally.

In practical applications (as will be seen in the "Examples" section later), the high explosive-aluminum mixture may be contained by the shell of an explosive device, such as the case of a capsule type shaped charge or a torpedo, a container of any proper material such as steel, aluminum, plastic or even water-proof paper, or, a group of such explosive devices are collectively contained in a big container, such as that practiced in the oil well perforating industry where a multitude of shaped charges are contained in a tubular steel perforating gun. To create the said subsequent explosive event, the said charge containers or shells, cases of the charge are submerged in an oxygen carrying liquid such as water. Upon detonation of the explosive charge, the said charge shells or cases are broken into pieces. When the shaped charges are contained in a tubular perforating gun, the gun is punched by the jets, leaving holes on the gun. The surplus aluminum in molten state produced as described above now expands violently and rapidly into the oxygen carrying liquid such as water, forcing the liquid form Al (or even in vapor form, if the Al content for a RDX/Al mixture falls in zone II as shown in FIG. 2) to interact with the said oxygen carrying liquid such as water, releasing a lot of energy and gaseous materials which can be used to enhance the mechanical effects created by the detonation of the explosive charge.

Embodiment 2 by Combustion or Detonation of an Oxidizer/Al Mixture

In the second embodiment of the of the present invention to produce Al in molten state, aluminum (preferably in powder form) is mixed with commonly used oxygen carrying reagents and aluminum is surplus in stoichiometry in the mixture. The oxygen carrying reagents, here generally referred as oxidizers, can be a metal oxide, a chlorate, perchlorate or nitrates that are compatible with aluminum powder, or even water or water solution of the said chlorate, perchlorate and nitrate. When such a mixture is used, the thermal energy to heat the reaction products along with the surplus aluminum may come from one or two sources depending on the oxidizer actually used and also the properties of the mixture (detonable or not). If the mixture is not detonable, the thermal energy released from the combustion reaction between aluminum and the oxidizer is the only energy source to heat the reaction products along with the surplus aluminum to a high temperature. However, some oxidizers like nitrates, chlorates and perchlorates, they are by themselves detonable "low explosives", or when they are mixed with aluminum at a certain ratio, the mixture is detonable. In the case that the said oxidizer/Al mixture is detonable, the thermal energy will come from two sources, from the detonation of the mixture and from the reactions between the detonation products and aluminum powder. The process is similar to the HE/Al mixture, described in embodiment 1 to produce aluminum in molten state of the present invention, except that the detonation of an oxidizer/Al mixture is generally not as powerful as that of a high explosive.

The exothermic reaction of the mixture can be actuated by a proper means such as ohmic heating with an electric wire, by detonating a small high explosive boost charge or by igniting a combustion boost charge. Such an initiation device can be designed by those skilled in the art and will not be detailed in this patent. The said oxidizer that can be used to mix with aluminum in the purpose to produce aluminum in its molten state can be from one of the following groups:

a) Nitrates, chlorates or perchlorates (some of the nitrates and perchlorates are also classified as low order explosives, like Ammonium Nitrate, Patassium Perchlorate) that are chemically compatible with aluminum powder until the mixture is intentionally activated. A mixture of aluminum with oxygen-rich reagents like nitrates and perchlorates can be ignited to detonate or deflagrate, giving off a large amount of heat and gaseous materials, the reaction is an explosive event. If there is a surplus amount of aluminum in the mixture, the surplus portion along with the reaction products from the chemical reaction between the stoichiometrical portion of aluminum and the oxidizer is heated along with the reaction products to a high temperature. The temperature of surplus aluminum along with the reaction products for a specific mixture can also be determined by calculations or by experiments. The properties of some of such nitrates, chlorates and perchlorates are listed in FIG. 3.

b) Metal oxides that are chemically compatible with aluminum powder until the mixture is intentionally actuated. Examples of metal oxides are, but not limited to: copper oxide (CuO), cuprous oxide ($Cu_2O$), Ferrous oxide (FeO), Ferric Oxide ($Fe_2O_3$), Triiron Tetroxide ($Fe_3O_4$), Cobalt Oxide ($Co_2O_3$), Zinc Oxide (ZnO), Lead Oxide (PbO), Lead Dioxide ($PbO_2$), Lead Tetroxide ($Pb_3O_4$), Manganese Dioxide ($MnO_2$), Stannous Oxide ($SnO_2$). Regarding the use of Al/metal oxide mixture, it is well known in the art that reaction of an Al/Ferric Oxide ($Fe_2O_3$) mixture, often called thermite reaction is used in welding operations. In a mixture of Al/$Fe_2O_3$ in which Al is surplus in stoichiometry, the surplus amount of Al will be heated to molten state and the temperature can be determined by altering the composition ratio in the mixture. A device made with surplus Al and a metal oxide produces Al in molten state upon ignition of the mixture. Unlike the process of the detonation of the high explosive/Al mixture, it is a non-explosive event due to the lack of gaseous material in the reaction products. However, the subsequent reactions of the produced Al in molten state on encountering with water are the same as that would be produced with the HE/Al mixture. To produce molten aluminum, one can also mix aluminum powder with some other chemical compounds that can decompose into a metal oxide and other materials under raised temperatures, such as carbonates like Manganese Carbonate ($MnCO_3$), which releases Manganese Dioxide ($MnO_2$) when the temperature increases.

c) Water or water solutions of some oxygen-rich reagents like nitrates, chlorates and perchlorates. A mixture of aluminum (preferably in powder form) with liquid water can be ignited by an electrical pulse, giving off a large amount of heat and releasing hydrogen gas. In the present invention, the Al/water mixture can be mixed in ways similar to those already described, that is, to use a surplus amount of aluminum in stoichiometry in the mixture. Upon ignition of the mixture, all the water in the mixture is consumed in the Al/water reaction. The heat generated will be used in heating the reaction products as well as the surplus Al (the part of Al that remains unreacted after all the water in the mixture is consumed) to a high temperature. The temperature of the surplus aluminum (and the reaction products) can also be calculated. To increase the reactivity of water, a water solution of some oxygen-rich reagents such as nitrates, perchlorates can be used in place of plain water. The main properties of such reagents are tabulated in FIG. 3. As will be disclosed later, the water solution of such reagents is also used to increase Al—$H_2O$ reactivity. The molten Al producing process in this category is an explosive event due to the existence of gaseous materials such as hydrogen gas ($H_2$) and the large amount of heat generated, although not as violent as that with the detonation of the high explosive/Al mixture, as described previously. After the molten Al is produced, its reaction with water on encountering with the latter is the same as molten Al produced with the other processes described earlier. Compared to the high explosive/aluminum and metal oxide (nitrates or perchlorates)/aluminum mixtures used to produce molten aluminum as described above, such a mixture of water (water solution of oxygen-rich reagents) with aluminum may be more difficult to initiate. The use of special boost devices (such as those that may include the use of high explosives, metal oxide/aluminum mixtures) may be necessary and which can be designed by those skilled in the art.

As is known, water is chemically neutral under normal conditions but it does behave like an oxidizer in that it releases its oxygen to react with Al when it encounters aluminum in molten state. In U.S. Pat. No. 5,052,272, water is used and called an oxidizer in a device to launch a projectile. In that patent to Lee, a conducting wire is energized by electrical power so that it melts and is dispersed into a mixture of aluminum powder and water, initiating the reaction between them and using the hydrogen gas released to propel a projectile. However, in the referenced patent, there is no intent to create a dual-explosion and to produce molten aluminum by using a surplus amount of aluminum in the aluminum powder-water mixture. On the contrary, according to the inventor, an excessive amount of water is used in stoichiometry. For the actuation of an aluminum-water mixture, the use of other methods is possible such as by using a boost high explosive charge, by using an Al/metal oxide initiation unit. Such actuation devices can be designed by those skilled in the art and are beyond the scope of the present invention, and therefore will not be discussed in detail.

Figure 4:
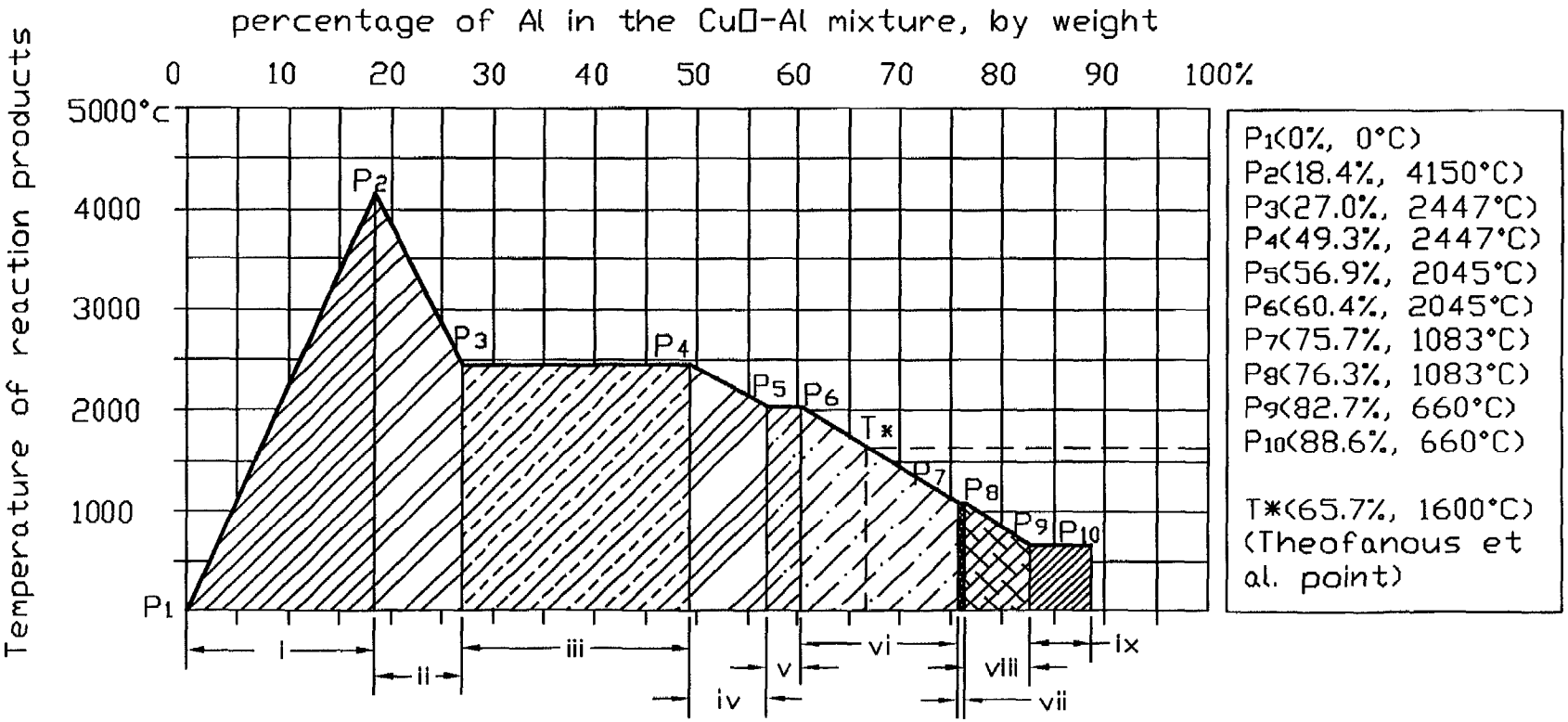
FIG. 4 plots the temperature of reaction products from a CuO/Al mixture as a function of Al content (by weight) in the mixture.

The temperature of the surplus aluminum as produced by an oxidizer/Al mixture can be calculated similarly as with the HE/Al mixture. FIG. 4 shows an example to predict the temperature of the surplus aluminum (along with the reaction products) from the reaction of the Al/CuO mixture. Similar to the high HE/Al example described previously, shown here are just exemplary results and a method of how to calculate the aluminum temperature in this category. It is not intended to limit the present invention to this example. Furthermore, the data shown in the figure and in the calculations are for illustration purposes only and are not intended to be accurate and exact. They may change significantly depending on the source of some raw data such as the heat capacities of some reaction products, and also depending on the method of calculation used.

Shown in FIG. 4 is the temperature of reaction products (with surplus aluminum among them) as a function of aluminum content by weight in the mixture of Al/CuO. For chemical reaction equations, see EQ 2 and EQ10in FIG. 1. Determined mainly by the phase change of the reaction products, the temperature-Al content is divided into 9 zones, described as follows:

In zone i, temperature increases from 0° C. at point $P_1$ (for simplicity, 0° C. ambient temperature was assumed for the calculations) to the maximum of 4150° C. at the stoichiometry point $P_2$ (aluminum 18.4%, CuO 81.6%) by weight. This is different from zone I for the RDX/Al mixture as shown in FIG. 1, where the initial temperature is the detonation temperature of RDX. In this zone, all the aluminum present in the mixture is consumed in the reaction and there is no surplus Al in the reaction products.

In zone ii, defined by points $P_2$(18.4%, 4150° C.) and $P_3$(27.0%, 2447° C.), surplus aluminum produced is in vapor form. The reaction products like Cu and $Al_2O_3$ are partly in vapor form (vaporization point of $Al_2O_3$ is 2908° C. and that for Cu is 2595° C., the reaction does not release enough heat to vaporize all of them).

Surplus Al experiences a phase change from vapor to liquid form in zone iii. The two points $P_3$(27.0%, 2447° C.), $P_4$(49.3%, 2447° C.) defining this zone have the same temperature of 2447° C., the vaporization point of aluminum. Point $P_3$ (27.0%, 2447° C.) corresponds to a status in which all the surplus aluminum is in vapor form while point $P_4$ (49.3%, 2447° C.) corresponds to all the surplus aluminum in liquid form. The reaction products Cu and $Al_2O_3$ are all in liquid form in this zone.

In zone iv defined by points $P_4$(49.3%, 2447° C.) and $P_5$(56.9%, 2045° C.) surplus aluminum as well as Cu and $Al_2O_3$ in the reaction products are all in liquid form.

Zone v sees the phase change of $Al_2O_3$ at a temperature of 2045° C. (melting point of $Al_2O_3$) from liquid form to solid form. Defined by points $P_5$ (56.9%, 2045° C.) and $P_6$ (60.4%, 2045° C.), this zone has the surplus Al and the reaction product Cu in liquid form.

Zone vi defined by points $P_6$(60.4%, 2045° C.), $P_7$(75.7%, 1083° C.), surplus aluminum and the reaction product Cu are all in liquid form but another reaction product $Al_2O_3$ is solid. The temperature of molten aluminum at which complete chemical reaction occurs on encountering liquid water as reported by Theofanous et al. falls in this regime. Denoted as T* in FIG. 4, this temperature is 1600° C. and the calculated Al content in the Al/CuO mixture corresponding to this temperature is 65.7%.

Zone vii is where the reaction product Cu changes phase from liquid to solid at a temperature of 1083° C., the melting point of Cu. In this zone, the other reaction product $Al_2O_3$ is in solid form and the surplus Al is in liquid form.

In zone viii defined by points $P_8$ (76.3%, 1083° C.) and $P_9$(82.7%, 660° C.), only surplus aluminum is in liquid form. The reaction products CuO and $Al_2O_3$ are all in solid form.

In zone ix defined by points $P_9$(82.7%, 660° C.) and $P_{10}$ (88.6%, 660° C.), liquid and solid forms of surplus aluminum coexist.

In practical applications, a temperature-Al content chart as plotted in FIG. 4 is useful to determine the compositions of an explosive device designed to utilize the Al—$H_2O$ reaction. For example, if a device uses the mixture of Al/CuO as energetic material and the device is to be actuated in plain water, then the Al content in the mixture should be between point $P_2$ and the Theofanous et al. point T*, ie., from 18.4% to 65.7% by weight. However, if the device is to be actuated in a water solution of some oxygen-rich reagents like one of that listed in FIG. 3 (reactivity enhancement will be disclosed in detail later in this invention), with which the reactivity between Al and water will be enhanced and the minimum temperature of Al for a complete chemical reaction can be lower, the aluminum content can be higher than 65.7% till point $P_{10}$(88.6%).

For other aluminum-oxidizer mixtures, a similar Temperature-Al content chart to that shown in FIG. 4 for the Al/CuO mixture can be plotted. In an aluminum-water mixture to produce molten aluminum, when $H_2O$ is replaced by a water solution of some oxygen-rich reagents like one of that listed in FIG. 3, the reactivity will be increased. Depending on the actual reagent used and its concentration in the water solution, similar temperature-Al content charts can also be plotted.

Embodiment 3 by Shocking/Heating Al

In addition to the two embodiments of chemical methods to produce molten aluminum described, there is still a third embodiment, namely the shock wave along with reaction products heating method. In this method, the aluminum material can be either in solid form, or be compacted aluminum powder. Often the shock wave alone from the detonation of an explosive charge may not have enough energy to melt aluminum, but if the aluminum material comes in contact with the explosive charge, the high temperature detonation products along with the said shock heating will put the aluminum material well above its melting point. Consequently, typical uses of this method can be to make shaped charge liners, cases, charge carriers completely or partly with aluminum. Then upon detonation of the explosive charge, the liner material projected into a perforation, the shaped charge case and carrier heated and broken in a well bore, can all be forced to interact with water and cause a powerful secondary explosion.

Figure 5:
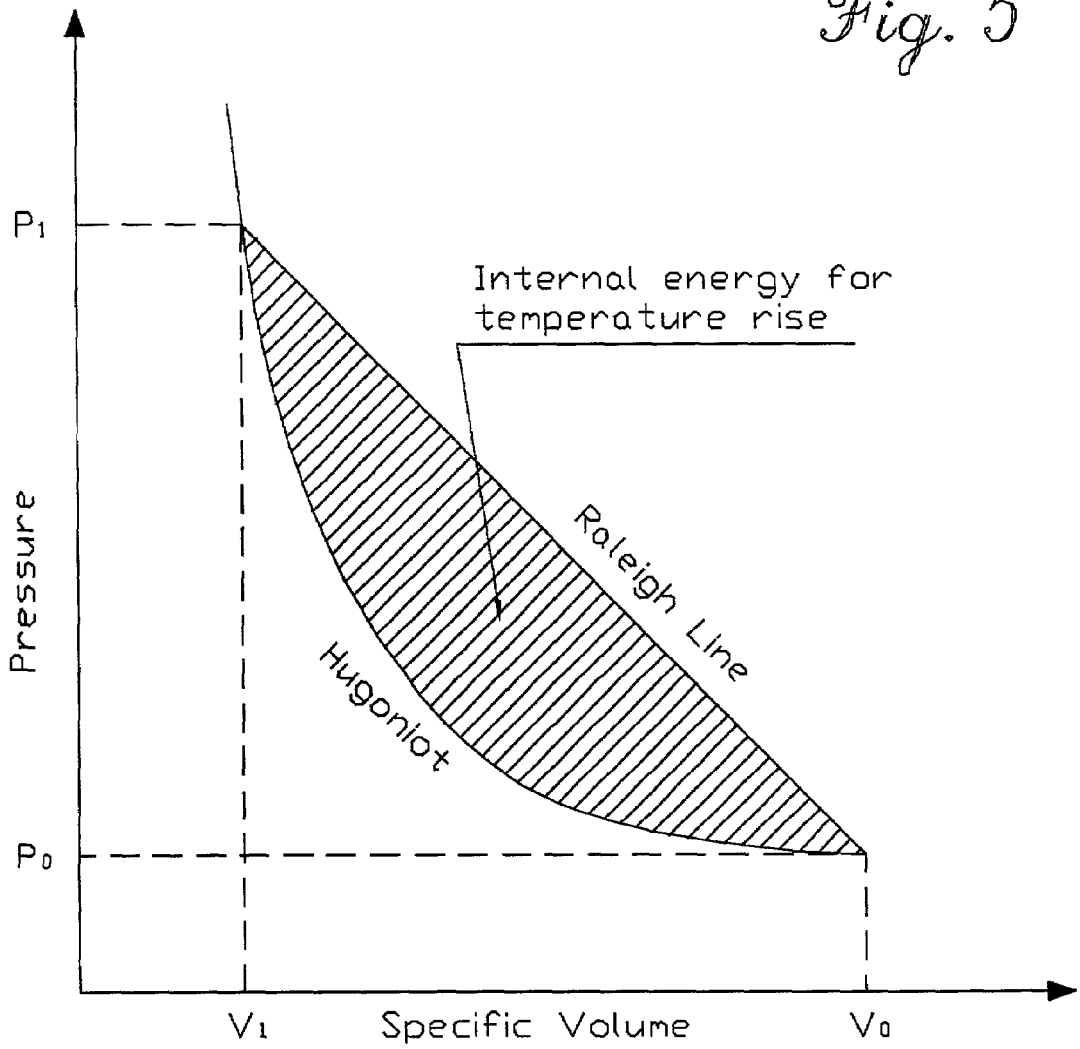
FIG. 5 shows the internal energy change for temperature rise for a solid material like Al loaded by a shock wave, and the shadowed area represents the energy available for a temperature rise.

It is known in shock physics that once a metallic material like aluminum, copper or iron is shocked, the temperature of the material increases instantly. FIG. 5 shows a typical P-V (pressure-specific volume) Hugoniot for a solid material. It shows that when a solid material is shocked from its initial state ($P_0$, $V_0$) to its final state ($P_1$, $V_1$) along the Raleigh line, and then relieved along the Hugoniot line there is an internal energy change. This part of internal energy change is in the form of thermal energy increase, i.e., a temperature increase for the solid material after the shock. Depending on the peak pressure, the duration of the shock wave and the thermal properties of the metal being shocked, the temperature rise can be high enough to melt or even vaporize the metal.

For example, when solid aluminum is subjected to a shock wave, it starts to melt at a pressure of 0.6 Mbar and melts completely at 0.9 Mbar. It is known that most high explosives have a detonation pressure in the order of 0.3~0.4 Mbar (for example, RDX has a detonation pressure of 0.338 Mbar at a density of 1.767 g/cm$^3$, and the detonation pressure for HMX is 0.393 Mbar at a density of 1.90 g/cm$^3$). Obviously, the shock wave alone from the detonation of explosives is not sufficient to melt solid metal. However, when aluminum is used as a component of an explosive device such as a shaped charge liner or case, or charge carrier as will be shown in the embodiments of the present invention, upon detonation of the explosives, it is firstly heated by the shock wave, and then further heated by the high temperature detonation products. When Al is used as a shaped charge liner material, in addition to the first shock by the detonation of the explosive charge, the collision of the liner elements in the centerline of the charge creates another shock. That is, the liner is accelerated to collapse and to collide along the centerline of the shaped charge. This second time shock along with the detonation products heating will further increase the temperature of the collapsed liner. The final temperature will be high enough to melt aluminum and have it ready for the subsequent aluminum-water reaction. Similar to what described previously, to achieve complete reaction when aluminum is at a relatively low temperature, water solution of some oxygen-rich reagents like nitrates, perchlorates can be used in place of plain water. Therefore, it is possible to use the charge case or charge carrier as an energetic material if they are made of aluminum, which upon detonation of the explosive charge can be shocked and be heated to a high temperature and then induce a powerful Al—$H_2O$ (water solution of oxygen-rich reagents) reaction.

Numerous other variations based on the above three embodiments to produce molten aluminum in its molten state are possible, without departure from the spirit described above. Theoretically, any detonable or combustible mixture that has an exothermic reaction can be used to mix with Al in an surplus amount in stoichiometry to produce molten aluminum to react with water. Possible variations include but are not limited to:

1) The high explosive used is a mixture of two or more than two explosives, such as a mixture of RDX and TNT;
2) The combustible mixture is not limited to be a mixture of oxidizer/Al, but it can also be a propellant, a pyrotechnic mixture, etc.;
3) Aluminum powder is not directly mixed with metal oxides, but with some chemical compounds that can be decomposed into metal oxides and other materials under raised temperatures such as some carbonates, like Manganese Carbonate ($MnCO_3$).
4) In stoichiometry, a part of aluminum is replaced by other materials that can be generally classified as "fuel", such as magnesium, lithium, zirconium, silicon, boron, etc.

So far in the specification of this invention, the use of aluminum is preferred as a fuel in the aluminum-water reaction. However, other light metals can also be used in place of aluminum without departure from the spirit of the present invention. Such substitutes include but are not limited to: aluminum in its alloy form with other metals, such as aluminum alloyed with magnesium, aluminum-lithium alloy, magnesium and its alloys, etc. The said substitutes can also be used in a surplus amount in stoichiometry to mix with high explosives or oxidizers in the purpose to produce molten metal and to react with water. Similarly, water solution of oxidizers can also be used in place of plain water so that its reactivity with the said substitute molten metal can be increased, as will be described in the present invention.

II. Method to Increase Al—$H_2O$ Reactivity

Aluminum at its high temperature has a tendency to react with oxygen. To free oxygen in water and react with it, aluminum has to be at a very high temperature so that the Al molecules have enough kinetic energy to break the H—O—H bond in water. The minimum temperature for Al to completely react with water is 1600° C., according to Theofanous et al., as described early. However, it is possible to lower the temperature of the molten aluminum needed for a complete chemical reaction if oxygen is easier to obtain, or the reactivity of the oxygen carrier (water) is increased. Disclosed herein is a method to increase the reactivity of water by dissolving oxygen-rich reagents into water.

It is well known that some oxygen-rich reagents like the commonly used nitrates, chlorates and perchlorates have a strong tendency to react with a fuel like Al, they release oxygen much easier than water does. A mixture of aluminum powder with any of these reagents can be detonable or combustible. When such a reagent is dissolved in water to react with molten aluminum, both the oxygen supplier and the "fuel" aluminum are in liquid phase, the reactivity between the water solution of the reagent with liquid Al will be greatly increased compared to the use of plain water. Consequently, the minimum temperature needed for Al to completely react with such a water solution can be greatly decreased. Such a decreased minimum temperature of Al with a specific reagent at a certain concentration can be determined theoretically or experimentally. For example, if molten Al is to be dispersed into a water solution of 10% nitrate, the minimum Al temperature for a complete reaction with the liquid will be significantly lower than 1600° C., the Theofanous et al. point. However, the temperature of Al should preferably be higher than 660° C., the melting point of Al, so that it is in liquid form and can interact and react homogeneously with the water solution of a reagent. As stated in U.S. Pat. No. 5,083,615 to McLaughlin, to produce heat and gas that increases the pressure of a system, homogeneous liquid/liquid reactions are advantageous. Many of the problems of reaction rate prediction and control associated with the heterogeneous solid/liquid reactions can be avoided in homogeneous liquid/liquid reactions.

The oxygen-rich reagents are well known in the art of manufacturing military and commercial explosives, propellants used as gun and rocket fuels, and pyrotechnic materials, like the nitrates, chlorates and perchlorates. Some examples of such materials are tabulated in FIG. 3, they include: Ammonium Nitrate ($NH_4NO_3$), Sodium Nitrate ($NaNO_3$), Potassium Nitrate ($KNO_3$), Barium Nitrate ($Ba(NO_3)_2$), Lead Nitrate ($Pb(NO_3)_2$), Potassium Perchlorate ($KClO_4$), Lithium Perchlorate ($LiClO_4$), Strontium Perchlorate ($Sr(ClO_4)_2$), Ammonium Perchlorate ($NH_4ClO_4$), etc. When the water solution of an oxygen-rich reagent is used, the surplus aluminum as produced by a chemical process such as the detonation of a high explosive charge will react with the reagent as well as water. Since it is easier for Al to react with such a reagent, it is possible to induce a "chain reaction" in the water solution. Firstly, some Al molecules react with an oxygen-rich reagent such as ammonium nitrate, the heat released is then used to heat the water solution as well as the unreacted Al. When the temperature of the unreacted Al reaches the Theofanous et al. point, it reacts completely with water. When a water solution of the said reagents is used, the reaction products will not be limited to hydrogen gas ($H_2$), other gaseous materials like nitrogen gas ($N_2$) may also be present in the reaction products, depending on the actual reagent used. Reaction equation EQ 9 in FIG. 1 is an example showing how Al would react with the said oxygen-rich reagent dissolved in water. Shown in the equation is the reaction between Al and Ammonium Nitrate ($NH_4NO_3$). This equation is a combination of different processes, including decomposition of Ammonium Nitrate ($NH_4NO_3$) and aluminum-oxygen reaction. As is seen, nitrogen gas ($N_2$) appears in the final reaction products in addition to aluminum oxide ($Al_2O_3$) and water ($H_2O$). If the said reagent has a high enough content in the water solution, it is also possible that hydrogen gas released from aluminum-water reaction will further react with the reagent and form water, contributing even more heat to the reactions.

III. Classes of Further Embodiments of the Present Invention

Once molten aluminum is produced by an explosive device in the presence of water, an Al—$H_2O$ reaction will immediately follow the actuation of the said explosive device. Here the explosive device refers to any device that is designed to detonate, to deflagrate and to output Al in its molten state using one or a combination of the three methods already disclosed. The device can be a detonable or combustible HE/Al or oxidizer/Al mixture in which Al is surplus in stoichiometry. The general purpose of the present invention is to create enhanced mechanical effects in a proper medium. An explosive device of the present invention is always used in presence of an oxygen-carrying liquid, such as water, or water solution of some oxygen-rich reagents. When it is used, it creates a "dual explosion" within the medium where the explosive device is used. The first is the primary reaction of the explosive device, which can be a detonation or a deflagration event, and the second is the powerful reaction between molten aluminum and water, or a water solution of an oxygen-rich reagent if the reactivity is enhanced with the said reagent. This is very different from the use of prior art explosive devices, including high explosive detonating devices, propellant combustion devices, fireworks etc., which create a "one time" event only. In the present invention, the second of the said "dual explosion" can output much more energy than the primary explosion. As described early in the present invention, 1 gram of Al reacting with water can output 3 times as much energy as 1 gram of high explosive like RDX (refer to EQ1 in FIG. 1 for thermal value, the energy released by 1 gram of Al reacting with water is less than reacting with pure oxygen, since a part of the energy is consumed in breaking the H—O—H bond in $H_2O$). Now refer to FIG. 2 and suppose that an explosive device uses 100 grams of RDX/Al mixture. At the Theofanous et al. point, 22.7 grams of RDX mixed with 77.3 grams of Al powder would produce nearly 72 grams (5.52 grams of Al will be consumed in the reactions with the detonation products) of Al at a temperature of 1600° C. The detonation heat of 22.7 grams of RDX would be about 143 KJ. If the 72 grams of Al completely react with water, the energy released would be 1260 KJ (see EQ1 in FIG. 1 for thermal value). This means, the ratio of energy output from the secondary explosion to the primary explosion would be 8.8. In other words, to achieve the same energy output, the "payload" of an explosive device of the present invention can be significantly lower than a similar device in the prior art. This reduction in "payload" can be very important to some applications, such as in the oil industry where the explosive devices need to be conveyed using proper means from ground surface to the subterranean formation zone to be treated, a torpedo that needs to be launched and propelled, and in mining and rock blasting where the explosives need to be hauled and shipped, etc.

The said medium can be any material within which an explosive device of the present invention is used. Examples are water, steel casing or tubing in an oil or gas well, hydrocarbon bearing formation, a rock stratum, a coal seam or concrete etc. The said mechanical effects in the said medium are the mechanical effects for which an explosive device is designed to achieve, which may include, but are not limited to, one or a combination of the following effects, pressure wave generation and propagation, pressurization and displacement of medium, target penetration and fracturing, crack initialization and propagation, medium disintegration, fragmentation and fragment movement, etc.

The present invention is primarily concerned about applications in the design of shaped charges, hydrocarbon bearing formation stimulation devices, explosive devices to be used in rock blasting, coal seam gasification and in defense industry. However, countless embodiments and variations are possible in different application areas without departure from the spirit of the present invention. The preferred embodiments are divided into 6 classes which are set out below.

Class 1: Shaped Charge to Create an Explosion in Target

In the oil and gas industry, the well that is drilled through hydrocarbon bearing formations is often cased with steel tubing, called casing. To establish a communication channel between the formation and the well so that the hydrocarbons can flow into the well and be recovered, an explosive device called a "shaped charge", or an "oil well perforator", is used. Generally tubular in appearance and symmetrical to a centerline axis, a shaped charge typically has three parts, namely a conical liner, a case and a certain amount of explosives. When a shaped charge is detonated, the liner collapses into a high velocity metal jet and a relatively low velocity slug traveling behind the jet. A substantial amount of explosive energy is transmitted to the jet and it travels along the centerline of the charge at a velocity in the order of 1000~9000 meters/per second. The jet is so powerful that it can penetrate through the steel casing, the concrete lining between the casing and the formation and then into the oil-bearing formation, establishing the said communication channel between the well and the formation.

Figure 6:
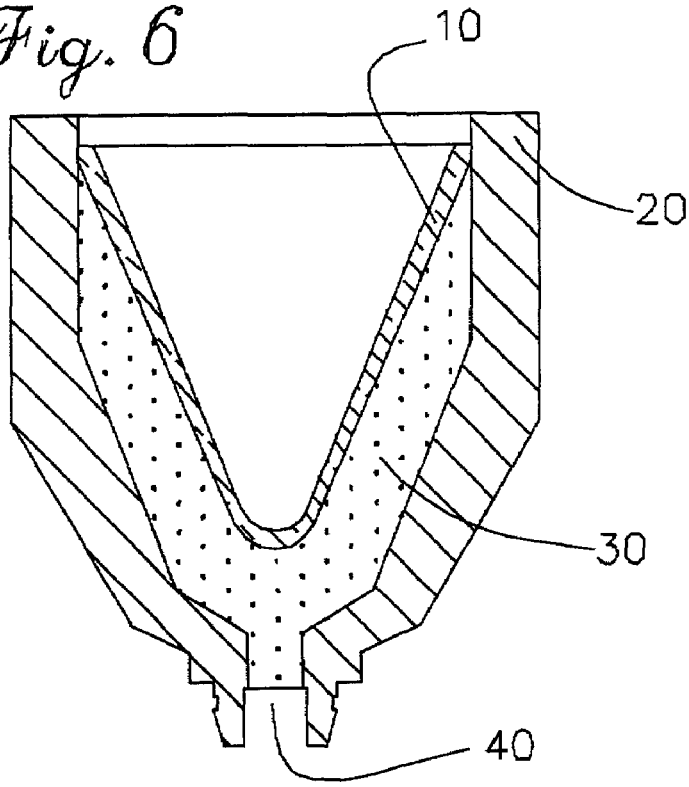
FIG. 6 shows the three components of an oil well shaped charge. The liner of the charge may be made of aluminum, so that upon collapse some molten aluminum can be projected into a perforation to react with water that is also forced to enter the perforation, creating a powerful explosion in the target.

As is known in the art, when a shaped charge is fired into the formation during a perforating operation, having liner materials remain in the perforation is not desired. No matter what the liner material is, either solid metal or powdered metal, it clogs the passage through which the hydrocarbons can run into the well and be recovered. A lot of efforts have been spent to develop a "slug-free" shaped charge. In a research work by Rinehart, J. S. et al., a shaped charge with a low melting point metal liner such as lead is used, the liner melts during collapse, forming a liquid slug which is dispersed. In a work by Delacour et al., the use of bimetallic liner for a shaped charge is used in the purpose to eliminate the slug from a collapsed liner. In the present invention, herein disclosed is a method to turn the "slug" into an energetic material, which does not clog the perforation. Instead, it reacts with water that is forced to enter the perforation and creates a powerful explosion in the perforation, fracturing the crushed zone and cleaning the perforation. The method is to make a shaped charge liner with aluminum, and then fire the charge in presence of water. FIG. 6 shows the cross sectional view of such an embodiment. Shown in the figure is a conical liner 10, a charge case 20, a certain amount of high explosives 30 such as RDX sandwiched between the liner 10 and case 20. Case 20 can be machined or cast from proper materials such as steel, aluminum or zinc, or be made by compacting powder metal. Also shown in the figure is a slot 40 to hold a detonating cord (not shown) that initiates the detonation of the high explosives 30 in operation. Upon initiation, the explosives 30 detonates at a velocity from 6000~9000 meters/per second. The explosives 30 turn into high temperature, high-pressure gaseous detonation products. Liner 10 in the figure can be made of solid aluminum or compacted aluminum powder. The use of a variation in the material is also possible, such as an aluminum alloy in solid form or in compacted powder form, or a mixture of aluminum powder with other powder materials such as copper powder, tungsten powder or lead powder etc. In the present invention, liner 10 is designed to function dual purposes, to form a jet to penetrate a target and to project some molten aluminum into the target along a perforation created. The liner material is heated to a high temperature using method 3 as described earlier in this invention, i.e., by shocking and heating. Upon detonation of the explosive charge, liner 10 is firstly shocked by the detonation of the explosives and then accelerated toward the centerline of the charge. When the liner elements collide in the said centerline, the liner is shocked once again by the collision and there is another temperature rise. Then some thermal energy from the high temperature detonation products is transferred to the collapsed liner while the latter is flying toward the target, heating it to an even higher temperature. The portion of the jet that has entered the perforation has a high enough temperature so that when water is forced to enter the perforation, it reacts completely with water to create a powerful explosion in the perforation.

As is known in the art of shaped charge design and manufacturing, charge penetration decreases when a decrease in liner density. Due to the low density of aluminum, a liner made of this material will have less penetration into a target than it would with copper and tungsten liners that have a higher density. However, so far as the perforating of a hydrocarbon bearing formation is concerned, perforating with the shaped charge of the present invention disclosed above may have even better results compared to the use of conventional shaped charges with high density liners. This is because of the in-perforation explosion that fractures the crushed zone of the perforation and initializes numerous cracks into the formation, greatly improve the permeability of the perforation. Additionally, the entrance hole of the perforation is bigger than that would be obtained with high-density liners. A big entrance hole makes it easier for the molten aluminum to be projected into the perforation and also easier for water to enter it. After the perforating is completed, it also makes it easier for the hydrocarbons to flow into the well.

However, with the shaped charge of the present invention, if a deeper penetration is required than that would be achieved with pure aluminum liner, a mixture of aluminum powder with other high density metal powders such as iron, tin, copper, lead, tungsten, etc. can be used. When liner 10 shown in FIG. 6 is to be manufactured by compacting metal powder, the metal powder can be pure aluminum or a mixture with another metal powder such as copper powder. The density of the liner can be adjusted by changing the ratio of aluminum in the mixture. Take the mixture of aluminum-copper powder as an example, any liner density from that of compacted aluminum powder to that of compacted copper powder is achievable by changing the ratio of the mixture from pure aluminum to pure copper powder. Then the right liner density for the required charge performance can be found. For example, a mixture of 50% aluminum powder with 50% copper powder used to make a liner would have a density more than two times higher than that made with pure aluminum powder. This would significantly increase the charge penetration, but the amount of aluminum in molten state that can be projected into the perforation will be reduced, and the reactivity of the molten aluminum with water will be decreased when it is wrapped by and mixed with copper powder. The use of a double layer liner would make a shaped charge capable of creating an explosion in the target without sacrificing the penetration.

Figure 7:
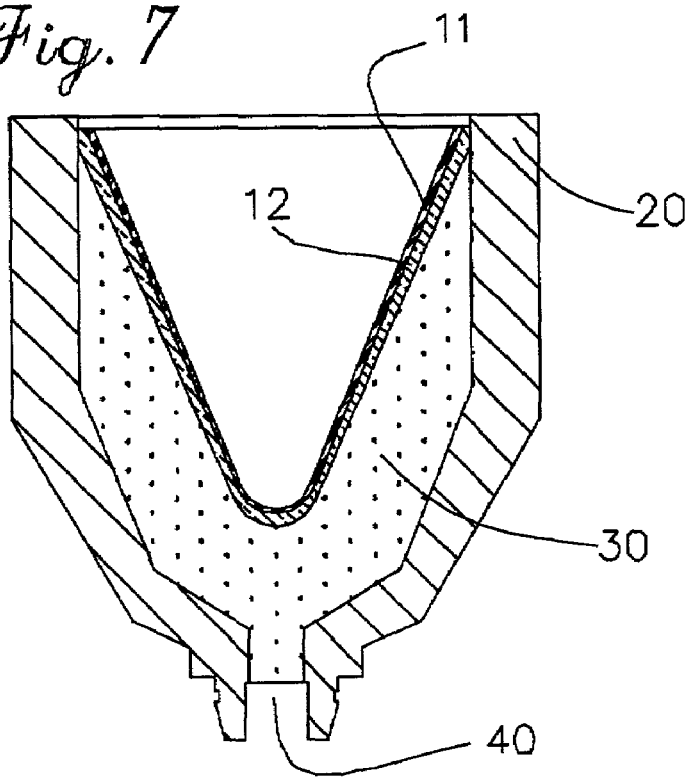
FIG. 7 shows an improved liner design. The shaped charge of this design is adapted to penetrate deep into a target due to the use of the high-density (airside) liner 11, which also creates an explosion in the target when fired in presence of water due to the use of the aluminum layer 12 on the explosive side.

In another embodiment of the present invention as illustrated in FIG. 7, the liner is shown to have two layers, a high-density airside layer 11 and a low-density explosive side layer 12. Layer 11 can be made of high-density compositions like iron, tin, copper, tungsten, lead etc., in solid alloy or in compacted powder form, as is used in conventional deep penetration shaped charges. The explosive-side layer can be made of solid aluminum or compacted aluminum powder. The use of double or multiple layer of liner is well-known in the art of shaped charge manufacturing, but to construct a shaped charge using aluminum containing liner and shoot it in presence of water in the purpose to utilize the Al—$H_2O$ reaction as disclosed here is a novel method. U.S. Pat. No. 4,498,367 to Skolnick et al. discloses methods for the determination of parameters for selecting materials for multi-layer shaped charge liners to transfer the greatest amount of explosive energy to the jet. In theoretical analysis of a multi-layer shaped charge liner, it is possible to have one material to completely enter the jet and the rest of the liner material be left in the slug, as reported by Curtis et al. FIG. 8 shows a penetrating jet and slug flying toward right. They are formed by the collapse of a bi-layer liner. The original shape of the liner is shown in FIG. 8(*a*). The airside (high-density) layer is ideally all turned into jet 11', as shown in FIG. 8(*b*) and all the explosive side layer 12 (low density, aluminum or aluminum-based) is left in slug 12'.

Figure 9:
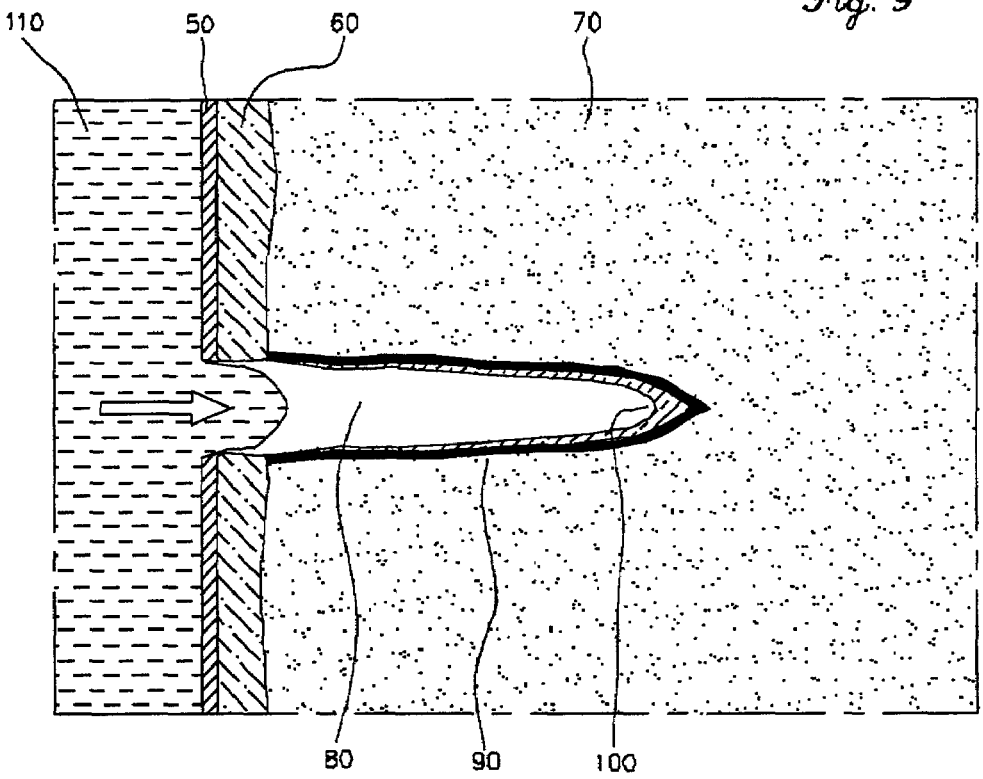
FIG. 9 shows a moment when a perforation in a hydrocarbon bearing formation 70 has just been created and molten aluminum 100 (from the collapsed liner) has entered the perforation 80. Water 110 in the well is now forced to enter the perforation too.

Upon detonation of the charge, a shaped charge liner made of aluminum or aluminum-based materials, in single or multiple layers as described above, is firstly heated by shock wave and by the detonation products to a temperature high enough to melt the liner. Then when it is propelled into the formation, it is further heated by the friction with the formation (kinetic energy carried by the jet is partly turned into thermal energy) and it reaches an even high temperature. FIG. 9 illustrates the Al—$H_2O$ reaction process after perforating. Shown in the figure is a steel casing 50, concrete lining 60 and the hydrocarbon-bearing formation 70. A perforation 80 is created by the shaped charge jet. There is a crushed zone 90 that has low permeability as stated previously, and a layer of molten aluminum 100 applied right on top of the crushed zone. Immediately after perforating, there is a pressure increase in the well due to the release of a substantial amount of detonation products from the charges. Consequently, water 110 in the well is forced to enter the perforation 80, reacting explosively with the molten aluminum 100 there.

For a shaped charge of the present invention as shown in FIG. 6 or FIG. 7, when the explosive used 30 is a mixture of high explosive and aluminum powder in the purpose to produce molten aluminum, such as a mixture of RDX and aluminum powder with aluminum content higher than 19.5% by weight (the stoichiometry point, as described previously), an amount of aluminum in liquid or vapor form will appear in the detonation products. Since in a perforating event of a shaped charge, a significant amount of detonation products is also propelled to enter the perforation that is created by the perforating jet, some aluminum in liquid or vapor form will also enter the perforation along with the detonation products. This part of aluminum can have a significantly higher temperature than that from the collapsed liner 100, it also reacts with water 110 that is forced to enter the perforation. Since it fills the whole space 80 of the perforation and it is more energetic due to its higher temperature, its reaction with water 110 happens earlier than the reaction between molten aluminum 100 and water 110.

Figure 10:
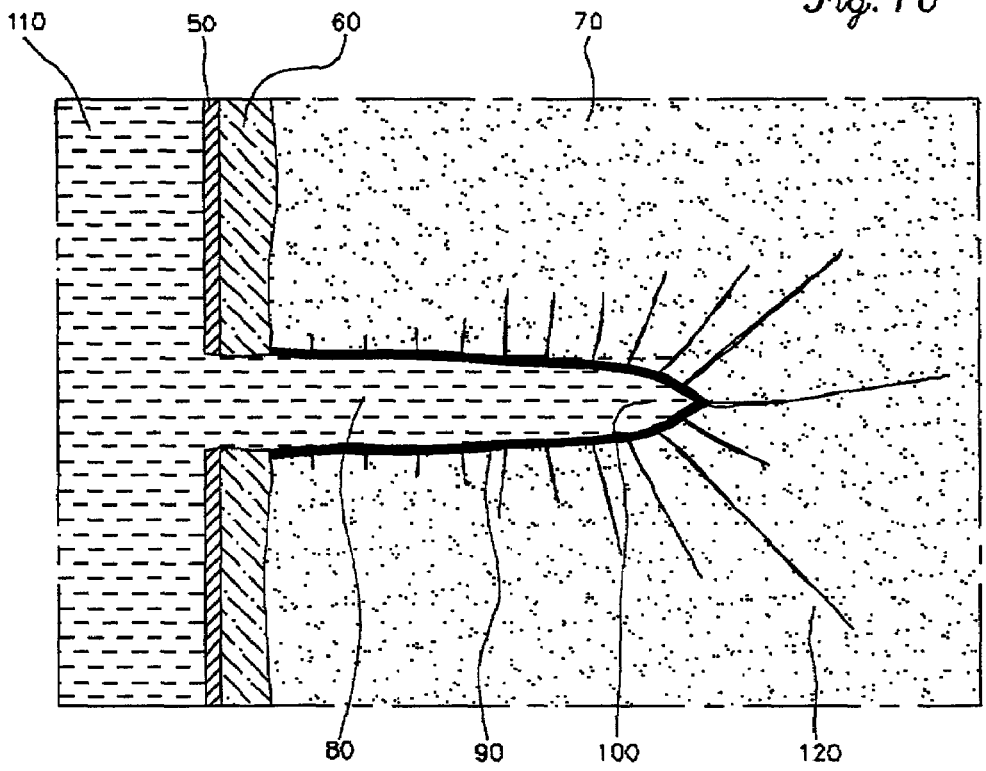
FIG. 10 is a conceptual illustration showing the status of the perforation after the aluminum-water explosion is completed whithin. Now the crushed zone 90 is fractured, and a multitude of cracks 120 have been initialized and developed in the formation 70.

Although the molten aluminum 100 may be only in gram quantities for a medium-sized shaped charge, given the fact that 1 gram of Al can give off a few times more energy than the same amount of high explosives, the explosion that it creates in the perforation can substantially improve the permeability of the perforation. The energetic Al—$H_2O$ reaction in the small perforation releases a large amount of heat and hydrogen gas, and generate a pressure pulse. After the explosion, the layer of molten aluminum in the perforation is consumed, the crushed zone 90 is pulverized and multiple fractures 120 are created in the formation, as shown in FIG. 10.

CLASS 2

Shaped Charge Liner Made of Al-based Energetic Material

In addition to the deep penetration type shaped charges that are designed to penetrate a formation as deep as possible, there is another family of shaped charges called big hole charges in oil industry, used particularly in perforating heavy-oil wells and in sand control. The purpose of this kind of charge is to create a big entrance hole on the well casing with only a few inches of penetration into the concrete lining and formation. In the prior art, this family of charges uses a solid metal liner such as brass liner. Unlike powder metal liners, solid liner leaves a slug, or called carrot in the perforation after the shot. The carrot in the perforation clogs the communication channel and it may be flushed back into the well, causing problems for other well operations such as pumping. U.S. Pat. No. 6,012,392 to Norman et al. discloses a method to make shaped charge liner using an alloy of nickel, tin and copper, it is claimed that such a shaped charge liner does not form a slug upon actuation of the charge. In the present invention, herein disclosed is a method to make shaped charge liner so that when the liner collapses, it carries not only kinetic energy but a substantial amount of thermal energy as well. The liner will be made of powder material such as aluminum powder and a metal oxide so that it is reduced to powder again when the liner collapses and it is especially for the big hole type charge but can also be used for deep penetration type charges, too.

Figure 11:
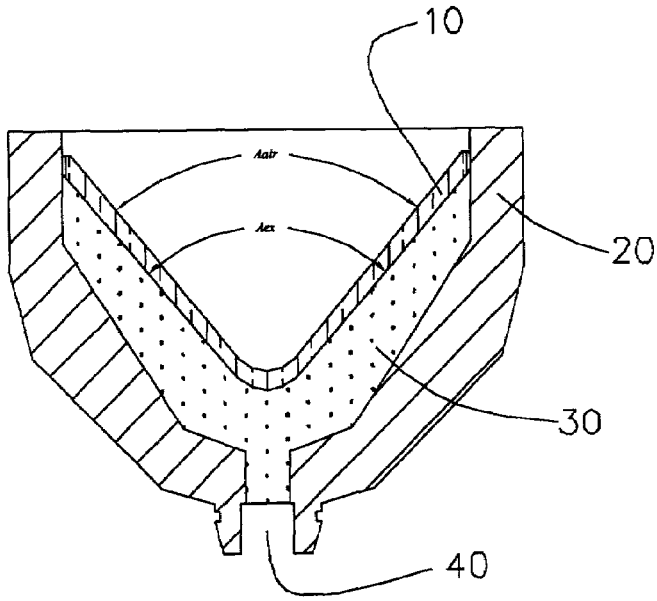
FIG. 11 shows the basic parameters for a big hole type shaped charge using an aluminum liner or Al-based energetic liner of the present invention.

As is well known in the art of shaped charge design and manufacturing, for given design parameters such as the type and amount of explosives used, case geometry, liner geometry and test set-up, the size of the entrance hole increases when the density of the liner material decreases (the opposite trend is true for penetration). Aluminum has a density of only 2.7 grams/$cm^3$, much lower than the commonly used metals for deep penetration charge liners, such as Copper (8.96 g/cc), Tungsten (19.5 g/cc) or Lead (11.34 g/cc). So, when aluminum is used for shaped charge liners, the resultant entrance hole size will be significantly larger. FIG. 11 illustrates the basic parameters of a big-hole type shaped charge of the present invention. Liner 10 is made of solid aluminum or aluminum alloy, or it is formed from aluminum or aluminum alloy powder or a mixture of aluminum powder with other metal powders like iron, copper, tin, tungsten and lead powders. Shown in the figure, the airside angle Aair and the explosive side angle Aex are shown to be larger than those typically used for deep penetration type charges. The shaped charge jet formation theories teach that a large liner angle is associated with a large jet mass that moves at a low velocity, which is helpful to create a perforation with large diameter. The actual angle values for this type of charge can change in a broad range from 40° to 150°, preferably be from 60° to 90°, depending on the requirements for the charge performance. The values of Aair and Aex can be equal to each other, so that the liner has a uniform thickness as it moves from the apex (the end that is close to the cord slot 40 shown in the figure) to the base (the end that is close to the open end of the charge) is uniform; or Aair is smaller than Aex, so that the liner thickness increases as it moves from the apex to the base; or Aair is larger than Aex, so that the liner thickness decreases as it moves from the apex to the base. However, to make a big hole type shaped charge, the liner can also take other shapes such as a parabolic shape, with or without a central hole at its apex. The generally conical liners shown in FIGS. 11, 13 and 14 of this invention are used to demonstrate the basic ideas of the invention only, they are not intended to limit the use of liner shapes to what are shown.

Figure 12:
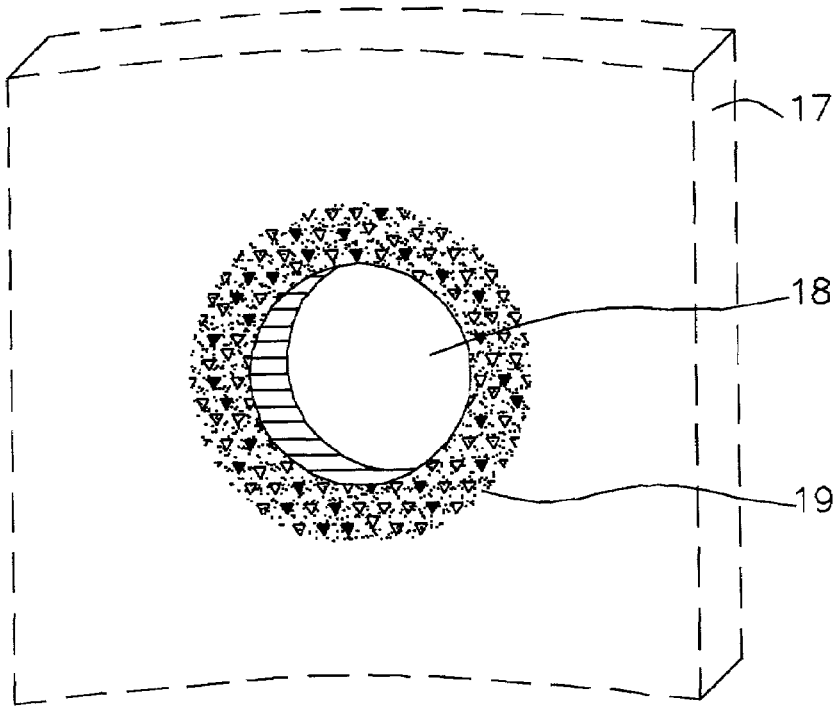
FIG. 12 shows slow-moving liner material 19 from a collapsed shaped charge liner spattered on and blocked by well-casing 17. By using Al-based energetic material as disclosed herein, hole 18 on casing 17 is enlarged by "burning" the target using material 19 that has a very high temperature.

In the use of shaped charges with powder metal liner (either deep penetration type or big hole type), it often happens that a part of liner material is left outside the steel casing surrounding the entrant hole of the perforation. Shown in FIG. 12 is such a circumstance. The shaped charge penetrates a hole 18 through the casing steel 17. A portion of liner material 19, maybe the slug of a collapsed liner (mainly from the part near the base of the liner), does not travel at high enough velocity to penetrate through the steel plate and it is blocked there and remained at the edge of the entrant hole. It would be appreciated if this portion of liner material 19 has enough energy to penetrate through the steel casing 17, making the final entrant hole significantly larger than the original one 18. In the present invention, a shaped charge liner is made of aluminum-based energetic material, so that when the charge is fired, it penetrates and "bums" a target.

As is known in the prior art, a shaped charge liner is always made of inert material. A shaped charge liner by itself does not carry any energy needed to penetrate a target. The energy is imparted to it by the detonation of the high explosive behind the liner. Then, when a shaped charge jet is formed, all the energy available to penetrate a target is the kinetic energy of the jet. In the present invention, a shaped charge liner made of energetic material is used, so that upon detonation of the charge, the collapsed liner (including the jet and slug) carries two parts of energy that can be used to pierce a target. One part is the kinetic energy transferred to the liner upon detonation of the explosive charge, and the other part is the thermal energy derived by the chemical reaction within the liner material that is actuated by the detonation of the explosive charge.

An embodiment of such a method to make an energetic liner is to use a mixture of aluminum powder with some metal oxides, such as copper oxide (CuO), Ferric Oxide ($Fe_2O_3$). Called thermite, the mixture of aluminum powder and Ferric Oxide is used to melt some metallic materials like steel. The thermite reaction is listed in EQ11, FIG. 1. A description of thermite incendiary can be found from a book by Davis, T. L., Thermite has a high ignition temperature and is safe to handle and transport. It is used to attack metal targets by applying localized heat and causing holes to be burned through metal. When an $Al/Fe_2O_3$ mixture is compacted and used as a liner material, the chemical reaction between aluminum and ferric oxide can be initiated by the detonation of the explosive charge, and also by the high temperature detonation products of the explosive charge. A study by Subramanian, V. S. et al. shows that to induce chemical reaction in an aluminum-ferric oxide mixture, very high shock pressure is needed. For a mixture compacted to 70% of theoretical maximum density, this pressure needed for complete reaction to take place is 22 Gpa. When the high explosive used for the shaped charge is RDX (detonation pressure 33.8 Gpa at a density of 1.767 g/cc) or HMX (detonation pressure 38.7 Gpa at a density of 1.89 g/cc), the detonation pressure will be high enough to actuate the chemical reaction between Al and $Fe_2O_3$ in the liner. Furthermore, the collision between the liner elements when they fly toward the symmetrical centerline of the charge, as well as heating by the high temperature detonation products of the explosive charge will all help to actuate this reaction within the liner.

When a shaped charge liner is made of Al-based energetic material such as the $Al/Fe_2O_3$ mixture, the energy carried by a collapsed liner can be much higher than a conventional, inert liner would carry. The internal energy of the high explosive loaded is the energy source for a prior art shaped charge. Suppose a shaped charge using 30 grams of RDX as main load, the internal energy of this amount of explosives is 189.6 KJ (suppose 6.32 KJ/gram for RDX) and that 50% of the energy is turned into kinetic energy of the collapsed liner (carried by both the jet and the slug), so all the energy available to the collapsed liner is 94.8 KJ in the form of kinetic energy. When a shaped charge of the present invention with Al-based energetic material is built, the energy carried by the collapsed liner can be substantially higher. Suppose the liner is a compacted $Al/Fe_2O_3$ mixture at its stoichiometry ratio and the weight of the liner is 40 grams, referring to EQ 11 in FIG. 1, for this amount of $Al/Fe_2O_3$ mixture, the thermal energy is 158.0 KJ, significantly higher than the kinetic energy carried by the collapsed liner. This amount of energy will greatly enhance the mechanical effects created by the shaped charge jet by further "burning" the target.

Refer now to FIG. 12, with the use of an energetic liner as described herein, now the material 19 that is blocked and remained on the edge of the entrant hole 18 carries a substantial amount of thermal energy. The temperature of the material 19 can be in the range of 2000~3000° C., this will melt the casing steel (melting point 1535° C.) that it comes in contact, making the hole significantly larger than the original hole 18 created by the shaped charge jet. The detonation products from the explosive charge blow away the molten metal from the casing and clear the perforation. Also, if the liner is designed to produce molten aluminum upon detonation of the charge and the charge is fired in presence of an oxygen-carrying liquid such as water, the aluminum/water reaction will take place locally in the perforation, enhancing the perforating effects and cleaning the perforation, as described previously.

When the shaped charge liner is made by compacting a mixture of Al/metal oxide powder, the collapsed liner will be in liquid form due to the shock by the explosive charge and the heat generated by the chemical reaction within the liner. The actual temperature of the liner upon collapse can be calculated and be adjusted by changing the composition of the liner mixture. By using aluminum that is surplus in stoichiometry or the metal oxide or with the addition of other inert materials into the liner mixture, a temperature of collapsed liner material can be controlled to be below the maximum temperature, which happens at the stoichiometry point. To achieve a high temperature for collapsed liner, it is possible to use other Al/oxidizer mixtures in addition to metal oxides, such as the nitrates, chlorates and perchlorates as described previously in the present invention. However, this is not preferred by the present invention due to the high reactivity of such mixtures (may cause safety problems in operation) and that, unlike an Al/metal oxide mixture, the reaction may be an explosive event and releases gaseous materials. The penetrating power of a shaped charge jet will be questionable if the jet contains gaseous material.

Metal oxides are normally not mixed with high explosives because of compatibility problems under raised temperature. For example, when RDX is mixed with $Fe_2O_3$ or CuO, it reacts with the metal oxide to produce unstable products that can be ignited at a temperature as low as 100° C. In the present invention of a shaped charge liner made of energetic materials, although the metal oxide is not directly mixed with the high explosive, as shown in FIG. 11, there exists an interface between the high explosive 30 and the liner 10 made of Al-based energetic material. Therefore, there exists the possibility that the fine particles of metal oxide in liner 10 and the high explosive particles interact with each other along the interface under raised temperatures. In the present invention, this is remedied by using a thin layer of inert material to isolate the said interface. Shown in figure FIG. 13, there is a shaped charge liner 10 made of Al-based energetic materials such as an Al/metal oxide mixture, an isolating layer 15 is placed between the explosive side of the energetic liner 10 and the explosive charge 30. The layer 15 can be made of any appropriate material such as copper, aluminum, plastic, paper etc. For example, an aluminum layer with a thickness of 0.003"~0.020" (0.08~0.51 mm) is suitable for the stated purposes. The layer 15 shown in the figure can be preformed from an aluminum foil, and it can be pressed into the shaped charge case 20 along with the energetic liner 10 during the assembly operation of the charge.

Figure 13:
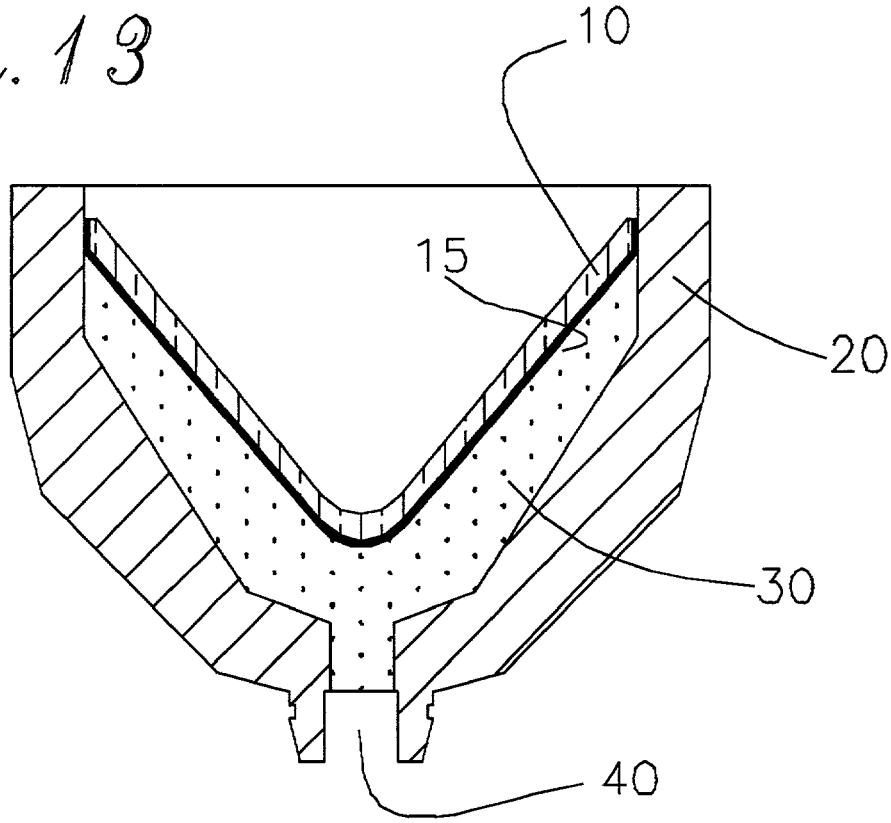
FIG. 13 shows an embodiment of a shaped charge of the present invention using a liner made of Al-based energetic material, preferably an Al/metal oxide mixture. An isolating layer 15 is used so that explosives 30 do not come in contact with the metal oxide particles in liner 10.

Referring to FIG. 13, to isolate the explosive 30 and the liner 10 which has a metal oxide in its composition, in addition to the use of a pre-made isolating layer described above, such an isolating layer can also be formed using a proper material during the manufacturing process of the shaped charge. One method is to heavily paint the explosive side of the liner with paint such as glyptal. The formed glyptal layer can be thick and strong so that it remains intact after the liner is assembled into the shaped charge. The other method is to preform the explosive 30 to its full density, then apply a layer of paint such as glyptal on the exposed side. If it is necessary, also apply a layer of paint such as glyptal on the explosive side of liner 10 before it is placed in the charge. Then the finished charge will have a layer of glyptal between the explosive and the liner to isolate them. Since explosive 30 has been compacted to its full density during preforming, only a small force is needed to place liner 10 in position. This force is so small that the glyptal layers on both the explosive side and the liner side are left intact after the assembly of the charge is completed.

Figure 14:
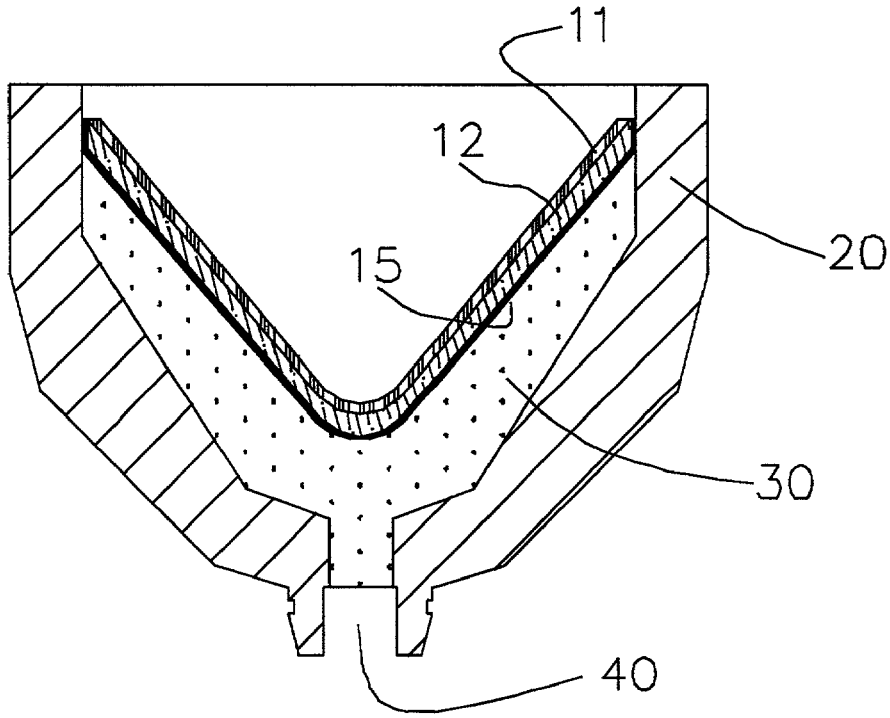
FIG. 14 shows another embodiment of a shaped charge to penetrate deep and to "burn" the target. The liner has 3 layers. Layer 11 on the airside is of high density and it is used to form a jet to penetrate a target; layer 12 is made of Al-based energetic material such as Al/metal oxide mixture; and, layer 15 is an isolating layer.

Due to the relatively low density of aluminum and metal oxides, a compacted mixture of Al/metal oxide used as shaped charge liner will have a density significantly lower than that made with other metal powders such as copper, lead and tungsten powders. Therefore, the use of an energetic liner of the present invention is normally associated with large entrant hole of the perforation but limited depth of penetration into the target. However, with another embodiment of the present invention, it is possible to create a big entrant hole and at the same time achieve a deep penetration, if this is needed by an application. FIG. 14 shows a shaped charge having a three-layer liner. The first layer 11 has a high density, it can be formed with metal powders having a high density such as copper, lead and tungsten powders, the middle layer 12, is an energetic layer of Al/metal oxide mixture and the third layer 15 is the said isolating layer. By properly choosing the density and thickness of the layers 11 and 12, the charge can be designed in such a way that upon detonation of the charge, the layer 11 enters the high velocity jet to penetrate the target and the energetic layer 12 mainly enters the slug which helps to make the entrant hole larger by penetrating and burning the target.

The shaped charge liner in this class of embodiment of the present invention can also be made with an Al/metal oxide mixture in which Al is surplus in stoichiometry, such as a mixture of $Al/Fe_2O_3$ with an excessive amount of Al in the composition. Then the collapsed liner has a very high temperature with molten and free Al in it. The method used to produce Al is a combination of method 2 (Al/Oxidizer mixture) and method 3 (shocking and heating) as already disclosed in the present invention. When a shaped charge liner made in this way is fired in presence of water, in addition to penetrating and burning the target, it will also induce an $Al—H_2O$ reaction in the perforation and near the entrant hole of the perforation. The effects of such an $Al—H_2O$ reaction will be similar to that described in the class 1 embodiments.

Class 3: Capsule Type Shaped Charge to Perforate and Stimulate

In the prior art to make shaped charges, the explosive used is typically a pure high explosive like RDX, HMX mixed with a small amount of phlegmatizers such as wax and some graphite powder as lubricant. As already discussed, for a conventional shaped charge, the portion of the explosive energy that is carried by the jet is the only energy available to do useful work. On the other hand, the perforation created by the high velocity jet in the formation bears a layer of hardened material often called a crushed zone. The crushed zone has a much lower permeability compared to the formation in its virgin state. Therefore, it impedes the flow of hydrocarbons into the well. Also, after firing the charge into the formation, a significant amount of liner material, no matter what the liner is made of solid metal or powder metal, is left in the perforation. For effective communication between the formation and the oil well, the crushed layer of the perforation should be pulverized and the materials remaining in the perforation should be removed. In the prior art, to remove the crushed zone and to clean the perforation, some subsequent procedures are necessary after perforating, like acidizing, flushing, hydraulic fracturing, propellant or explosive stimulation etc. U.S. Pat. No. 5,775,426 to Snider et al. describes a method to perforate and to stimulate simultaneously, the method includes the use of a sleeve of solid propellant wrapping the perforating gun within which the shaped charges are loaded and fired. The propellant sleeve in the prior art can be used with tubular perforating guns only, there is no method known yet in the prior art to complete perforating and stimulating in one trip by using capsule type charges. In the present invention, in addition to example 1, herein disclosed is another novel method to perforate and stimulate simultaneously without using propellants. The method is to create an $Al—H_2O$ explosion in the well immediately after the charges are detonated.

Figure 15:
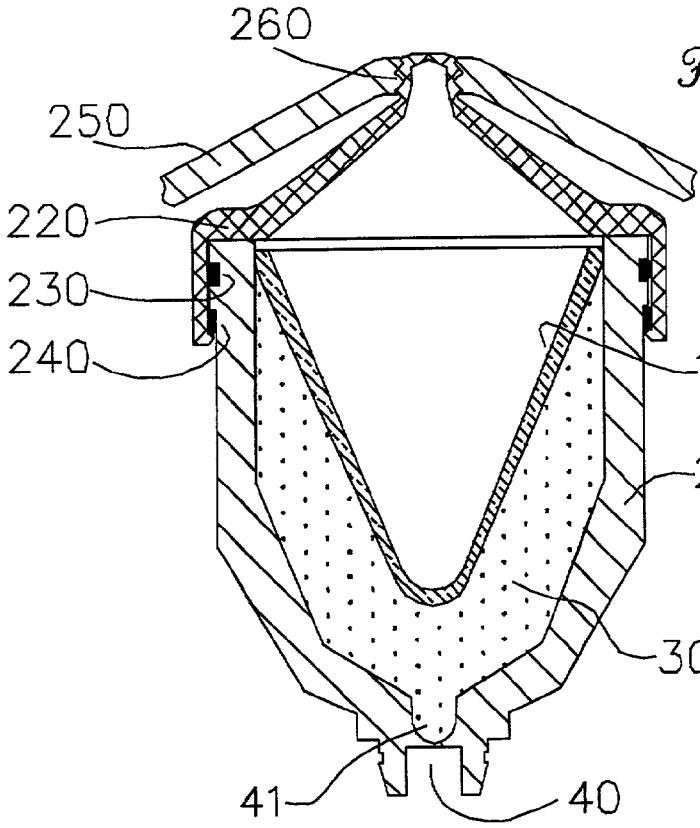
FIG. 15 shows an embodiment of the present invention designed as a fluid-tight, capsule type charge loaded on a strip charge carrier 260. Explosive 30 is a mixture of HE/Al with surplus Al in stoichiometry. The charge penetrates the target and releases a substantial amount of Al in molten state, inducing an Al—$H_2O$ reaction in water.

Shown in FIG. 15 is a capsule type shaped charge of the present invention to perforate and stimulate a subterranean formation simultaneously. Shown in the figure there are the liner 10, case 20, HE/Al mixture (in which Al is surplus in stoichiometry) 30, cord slot 40, primer hole 41 that is not drilled through, cap 220, sealing O-ring 230, cap-retaining ring 240. The technology to make a capsule charge is well described in U.S. Pat. Nos. 4,784,061 and 4,817,531, both to G. B. Christopher. When in use, a capsule charge is loaded onto a charge carrier that can be a straight strip, spiral strip, bi-wire charge carrier or any other proper charge carrier used in the art. Shown in the figure the capsule charge is connected to a strip 250 (the strip is not a part of the charge) through threads 260. When in use, a multitude of the charges connected to a carrier or other proper means are lowered into the well where the formation zone is to be treated. To induce the $Al—H_2O$ reaction, the well liquid in the zone where the charges are positioned should be an oxygen carrier like water or at least mainly water in chemical composition.

Shown in FIG. 15, explosive 30 is a HE/Al mixture in which aluminum powder is surplus in stoichiometry. If the high explosive 30 used is RDX and the aluminum powder in the mixture is more than 19.5% by weight (the stoichiometry point), there will be surplus aluminum produced after the detonation of the charge. The detonation of the explosives will collapse the liner to form a high velocity jet and to penetrate into the formation zone. Then a small part of the surplus aluminum in molten state (or even in vapor form depending on the actual aluminum content in the mixture) will enter the perforation that is created by the perforating jet, and a large amount is dispersed into water and forced to react with water on encountering the latter. The Al—$H_2O$ reaction is analogous to the combustion of propellants and generates a large amount of gas and heat. When the formation being perforated is properly sealed using devices such as mechanical or hydraulic packers, or there is a high enough liquid (such as water) column on top of the zone being perforated, significantly high pressure can be built up within the formation zone being treated, forcing the gas generated from the Al—$H_2O$ reaction along with well liquid such as water to enter the perforations just created, fracturing the crushed layers in the perforations and clean the perforations.

The addition of aluminum powder to high explosives will make the detonation velocity of the high explosives lower than without it. Also, as is described, a substantial amount of the detonation heat is consumed in heating the surplus aluminum. Therefore, explosive 30 which is now actually an HE/Al mixture shown in FIG. 15 may have a lower detonation velocity. Consequently, the jet formed may have a lower traveling velocity and lower penetrating power. However, if the subsequent Al—$H_2O$ reaction is energetic enough, additional cracks will be created from the perforation and the penetration effects will be greatly enhanced. In other words, the depth of penetration created by detonating a shaped charge of the present invention is no more as important as it is with conventional shaped charges. This is similar to the use of U.S. Pat. No. 5,775,426, when a propellant sleeve is used along with the shaped charges, in some applications the penetration depth can be much shorter as long as the perforation enters the formation, because the subsequent propellant combustion event will create and extend fractures to a depth much deeper than that can be reached by perforating alone. However, the present invention to build a shaped charge can also be embodied in such a way that the depth of penetration is not significantly affected, and yet there is a powerful Al—$H_2O$ reaction to follow. A simple solution is to load the explosives in two layers like that illustrated in FIG. 16. The explosive layer 31 embracing the liner has low or no aluminum content in the composition so that it has a high detonation velocity to collapse the liner; the other explosive layer 32 embraced by the case interior has a high percentage of aluminum content and it will be reliably detonated by layer 31 to release a large quantity of molten aluminum.

Figure 16:
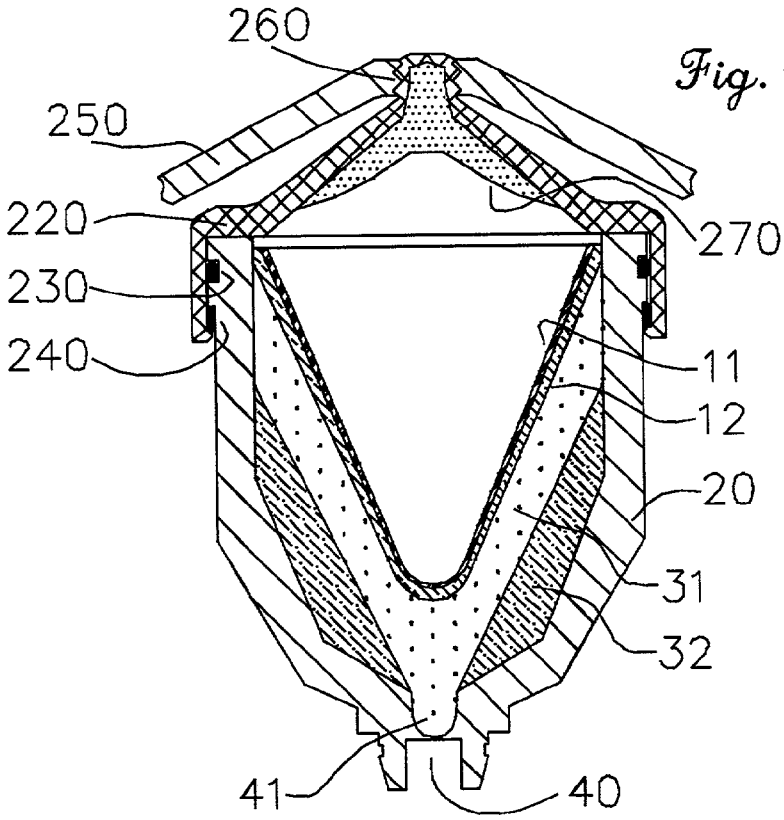
FIG. 16 shows another embodiment of a fluid-tight, capsule type shaped charge using a combination of all the three methods to produce molten aluminum. The explosives of the charge are loaded in two layers 31 and 32. The liner is also built in two layers 11 and 12, and there is a separate molten-aluminum producing unit 270 nested in the cap 220 of the charge.

The methods to produce surplus aluminum in molten state as disclosed and described already in the present invention can be used individually or in combination in the design of a capsule type charge. In FIG. 16, the capsule charge of the present invention that uses three methods combined to produce surplus aluminum in molten state. For the high explosive used in the charge, it is loaded in two layers 31 and 32, in the intent to use method one to produce aluminum in molten state, i.e., to use an HE/Al mixture in which Al is surplus in stoichiometry. As just described, layer 31 may have low or no Al content and the layer has a high detonation velocity, and layer 32 has a high Al content and it is specifically used to produce a large amount of aluminum in molten state which is dispersed into water (or water solution of oxygen-rich reagents) upon detonation of the charge.

Shown in FIG. 16 there is another molten-aluminum producing unit 270 when the explosives do not produce molten aluminum or more molten aluminum is needed in addition to that produced by the explosives. The part 270 which is pressed and retained in the cap 220 of the charge can be a "cake" of a mixture to produce surplus aluminum as already disclosed and described, such as a mixture of HE/Al in which aluminum is surplus in stoichiometry, or a mixture of an Al/oxidizer in which aluminum is surplus in stoichiometry, so the method used here to produce Al in molten state will be method one or two as described. In the illustrated shaped charge of the present invention shown in FIG. 16, the chemical reaction (which can be detonation for an HE/Al mixture, or combustion for an Al/oxidizer mixture) of "cake" 270 is initiated by the jet that penetrates through it and also by the detonation products from the explosives 31 and 32. In FIG. 16, the shaped charge liner is also shown to be constructed in two layers. Also as described, the airside layer 11 can be of high-density material and the explosive side layer 12 can be of aluminum or aluminum-based energetic mixture. Here layer 12 will be turned into liquid form using method three to produce molten Al. It is firstly shocked by the detonation of the explosives 31 and 32, reaching a high temperature, then further heated by the high temperature detonation products from the said explosives 31 and 32. To use method three to produce molten aluminum, case 20, cap 220 and charge carrier 260 can all be made of aluminum. There will be a temperature rise upon the detonation of the explosives of the charge. However, the temperature rise may not be high enough to melt all these parts. To induce an Al—$H_2O$ chemical reaction in the well using these parts, a water solution of oxygen-rich reagents can be used to increase the reactivity, as described previously.

When a capsule type charge as illustrated in FIG. 15 or FIG. 16 is submerged in water and detonated, the interaction between molten aluminum released from the charge with water is probably more similar to the process of a propellant combustion than a high explosive detonation. Here in the reaction both the fuel (Al in molten state) and the oxidizer (water) are in liquid form. However, Al may also be in vapor form such as produced by a RDX/Al mixture and the Al content is in zone II as shown in FIG. 2. In a study conducted by Lee, W. M., a pressure of up to 2.5 Kbar (35,750 psi) was measured with an electrically activated Al/$H_2O$ mixture contained in a polyethylene cartridge. If such an Al—$H_2O$ reaction is used to stimulate a hydrocarbon bearing formation, the peak pressure and duration of the pressure wave can be controlled to suit the application. As a comparison, Miller, K. K. et al. report the use of propellant sleeve that slides over conventional casing guns in perforating and stimulating. The measured peak pressure from the well bore was in the order of 9300 psi.

Figure 17:
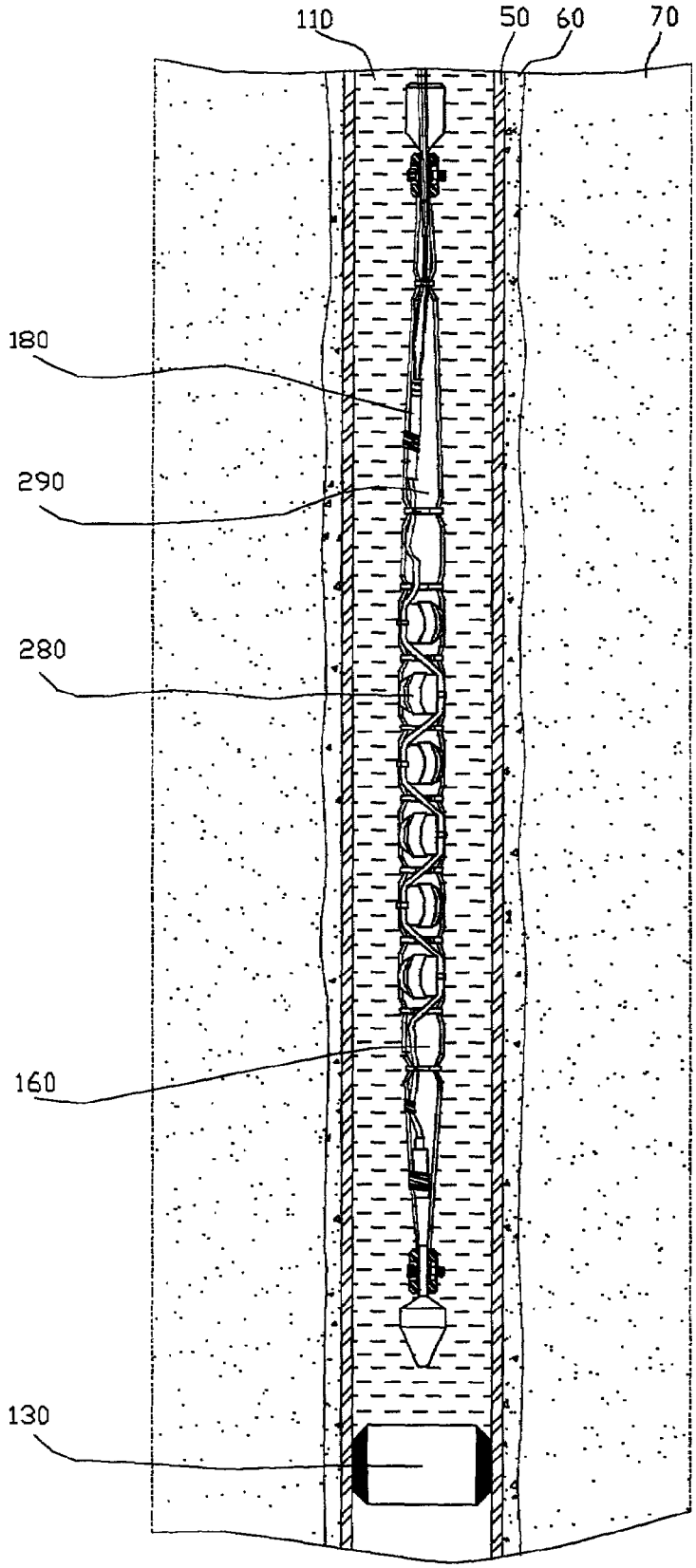
FIG. 17 shows the use of a capsule type charge to concurrently perforate and stimulate a formation. Charges 280 are conveyed to a formation 70 to be treated using a proper means such as a bi-wire carrier 290. The charges create perforations into formation 70 and induce a powerful Al—$H_2O$ reaction in the well, stimulating the formation along the perforations.

FIG. 17 illustrates a novel method and device to perforate and to stimulate simultaneously using capsule type charges of the present invention. In the figure there is a multiple capsule type charge 280 loaded onto a charge carrier 290 (shown in the figure is a bi-wire type charge carrier). A detonating cord 160 runs through the charges and it is connected to a detonator 180. The formation zone 70 to be treated is isolated from the other zones using a packer 130. The upper side of the zone 70 can be isolated using another packer, or by using a column of liquid on top of the liquid 110 shown in the figure and the liquid column is high enough so that the pressure it applies on the liquid 110 functions like a packer. The liquid 110 should be water or at least mainly composed of water, or if necessary, be a water solution of oxygen-rich reagents such as ammonium nitrate so that the reactivity between the released molten aluminum is greatly enhanced. Some water-soluble nitrates, chlorates and perchlorates are listed in FIG. 3 and their use to enhance reactivity has been disclosed early in the present invention. Upon detonation of the charges, a jet is created by each charge and it runs through the liquid 110, penetrating the casing 50, concrete lining 60 and into the formation 70. At the same time, the surplus aluminum produced by the detonation of the charges is dispersed into water and forced to react with water 110 (or the said water solution of oxygen-rich reagents), releasing a substantial amount of heat and gas. If the liner of charge 280 is made of aluminum or aluminum containing materials, some aluminum in molten state will be projected into the perforations. Since the velocity of a collapsed liner is high, the time interval needed for it to penetrate through water 110 (in the order of a few inches in dimension) in the well is only in the range of microseconds. Also, there will be only a small amount of molten aluminum that will come in contact with water 110 during its flight into the perforation. Therefore, there will be only a very small portion to react with water during the flight. Most of the molten aluminum will react with water after it has entered the perforation and then water is also forced to enter the perforation, as illustrated by FIGS. 10 and 11. The Al—$H_2O$ reactions that happen in the well along with that happen in each individual perforation (if molten aluminum is projected into the perforation) will create a very high-pressure pulse. As a result, the crushed zone in each perforation is pulverized, liner material remaining in the perforation is consumed by the energetic reaction, and multiple fractures are created from the perforations and propagated into the formation to a substantial depth.

Class 4: Shaped Charge to Perforate and Stimulate with a Perforating Gun

Unlike the capsule type shaped charge that is fluid-tight and can be directly exposed to well fluids, the shaped charges shown in FIGS. 6 and 7 have one end open. Charges of this type of design cannot be directly exposed to well fluid. In the art of oil well perforating, a tubular steel body called a perforating gun is used. In this class of preferred embodiments, a shaped charge having an open end can also be used with a tubular perforating gun to perforate and to stimulate a formation simultaneously. This application can be further divided into two categories depending where the molten Al is produced. One category is to produce molten Al inside the gun, as shown in FIG. 20, and the other category is to produce molten Al outside the gun, shown in FIG. 21.

Figure 18:
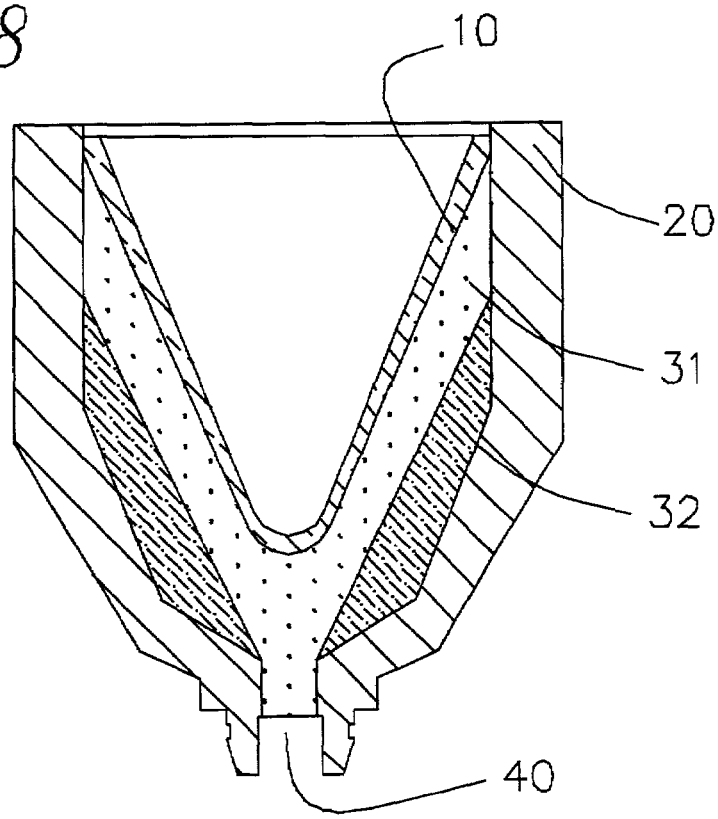
FIG. 18 shows an embodiment of an open-end shaped charge to perforate and stimulate, and to be used with a tubular perforating gun. Explosives are also loaded in two layers, namely a layer 31 to collapse the liner and another layer 32 to produce molten aluminum.

Similar to the capsule type charge as used in class 3 of the preferred embodiments of the present invention, the three methods used to produce molten aluminum as have been disclosed in the present invention can be used individually or in combination. FIG. 18 shows the design of an open-end shaped charge having two explosive layers 31 and 32. Similar to the capsule type charge shown in FIG. 16, 31 can be a layer of high explosive that has low or no Al content in the composition but it has a high detonation velocity to collapse the liner; layer 32 may have a high percentage in Al content and it is used to produce the molten aluminum for subsequent Al—$H_2O$ reaction. Its detonation velocity is lower but layer 31 will reliably detonate it.

Figure 19:
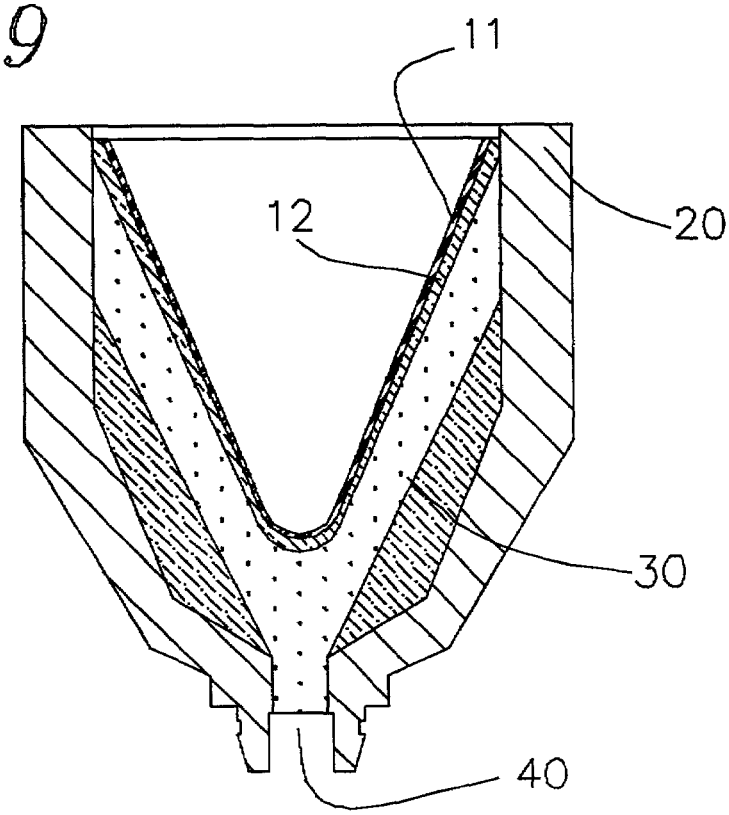
FIG. 19 shows another embodiment of an open-end charge to perforate and to stimulate. The liner is also in two layers, namely layer 11 is used to penetrate and layer 12 is used to produce molten aluminum for projection into a perforation.

In FIG. 19, in addition to the use of two explosive layers, the liner is also constructed in two layers 11 and 12. Similarly, liner layer 11 can be of high-density material and it is used to form a jet and to penetrate deep into the formation. The layer 12 can be based on aluminum material such as compacted aluminum powder. It is used to produce aluminum in molten state and then be projected into the perforation to react with water also forced to enter the perforation, creating a powerfull explosion locally in the perforation.

Figure 20:
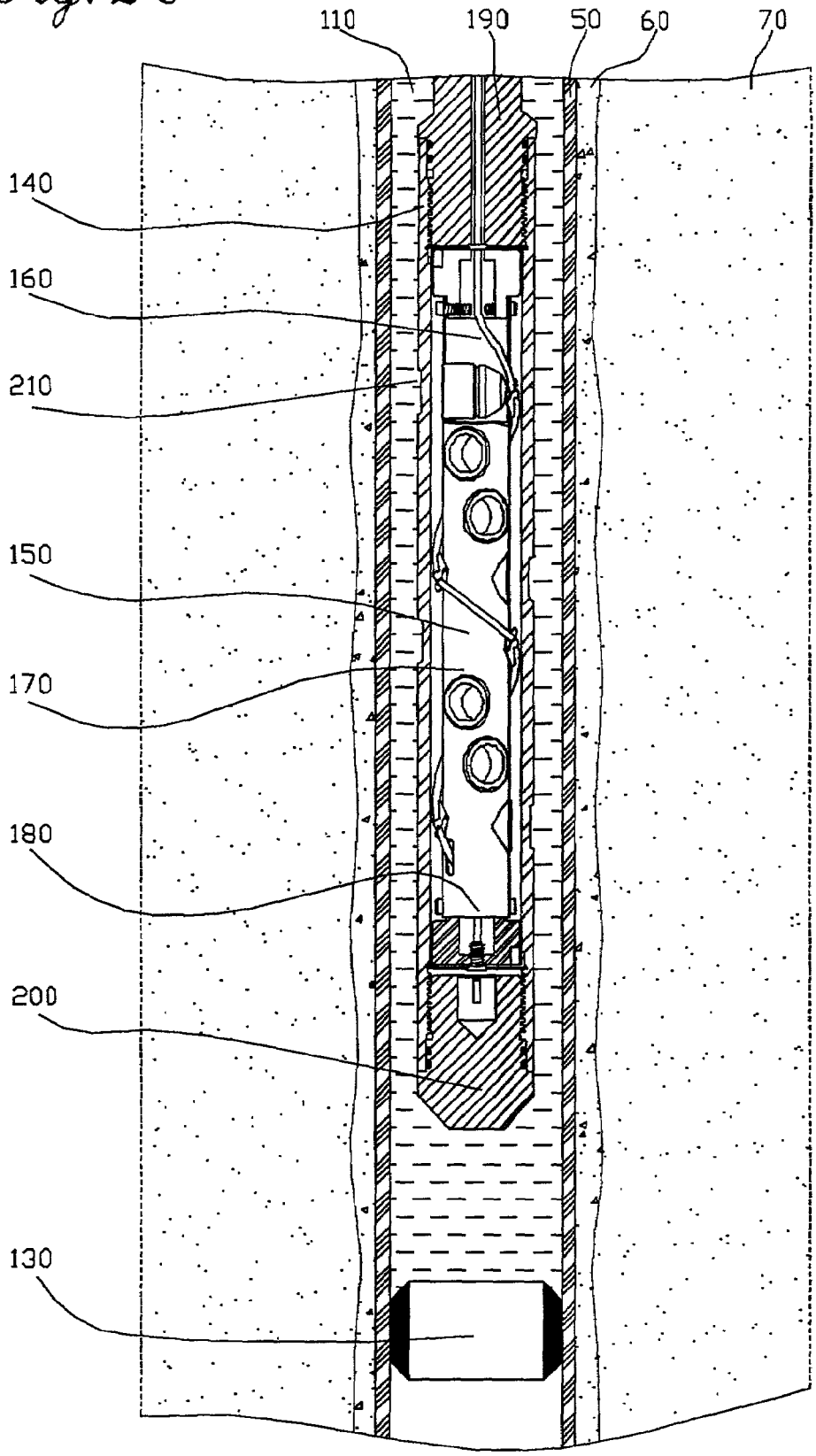
FIG. 20 shows the use of open-end charges with a perforating gun 140 to concurrently perforate and stimulate. Molten aluminum is produced within the gun upon detonation of the charges, then expelled into the well liquid, inducing an Al—$H_2O$ reaction to stimulate the formation along the perforations just created by the shaped charge jets.

FIG. 20 shows a multitude of open-end shaped charges loaded in a perforating gun to perforate and to stimulate a hydrocarbon-bearing formation, molten Al will be produced by the shaped charges inside the gun. In the figure, a plurality of shaped charges 170 of the present invention are arranged in a certain shot density (number of charges per unit length) and at certain phasing (angle between charge axes projected to a horizontal plane when the perforating gun is in vertical position) along a charge holder 150 (normally a thin-walled steel tube with holes to hold the charges). The charge holder 150 is contained in the perforating gun 140, which is sealed at both ends 190 and 200 against liquid fluid. The charges 170 are detonated using a detonating cord 160 that in turn is initiated by a detonator 180 in the gun. Upon detonation of a charge, a jet is formed which firstly penetrates the perforating gun 140 at the weakened portion 210 (called scallop), then through the well liquid 110 (in the present invention, to utilize the subsequent Al—$H_2O$ reaction, the well liquid is water, or at least mainly water, or when necessary, it is a water solution of an oxygen carrying reagent such as ammonium nitrate, as described earlier), the casing 50, concrete lining 60 into the formation 70. If the liner of the shaped charge is made of aluminum or aluminum-based materials (single or multilayer, as described above), some of the aluminum from the liner will be left in molten state in the perforations. After the perforating event, the interior of the perforating gun 140 is filled with high pressure, high temperature detonation products. The surplus aluminum in liquid or even vapor form produced by the detonation of the charges 170 is among the detonation products. Due to the pressure difference, the detonation products along with the said surplus Al in molten state are now forced to escape from the holes at the scallops 210 created by the shaped charge jet. When the surplus aluminum encounters water (or water solution of oxygen carriers) in the well, the energetic Al—$H_2O$ reaction takes place and the reaction is analogous to the combustion of rocket propellants. Since the formation zone 70 is isolated from other zones by using packers like 130 shown in the figure (on the upper side of the zone, it can be sealed using another packer, or, a liquid column high enough to function like a packer on the portion of liquid 110 shown in the figure). A substantial amount of gas and heat is generated in this zone, creating a high-pressure pulse in the zone. The well liquid 110 is further forced to enter the perforations created by the shaped charges. If there is molten Al in the perforation, the Al—$H_2O$ reaction will further happen locally in each perforation, releasing even more gas and energy particularly to fracture and clean the perforation. As a result of the perforating and subsequent stimulation using Al—$H_2O$ reaction, the perforations are created in the zone 70, then the crushed layers in the perforations are pulverized, "slugs" remained in the perforations are consumed and multiple fractures are developed in each perforation to extend to a substantial depth into the zone. By using the present invention, the final result to establish an effective communication channel between the formation and the well is not achievable with conventional perforating methods in the art.

Figure 21:
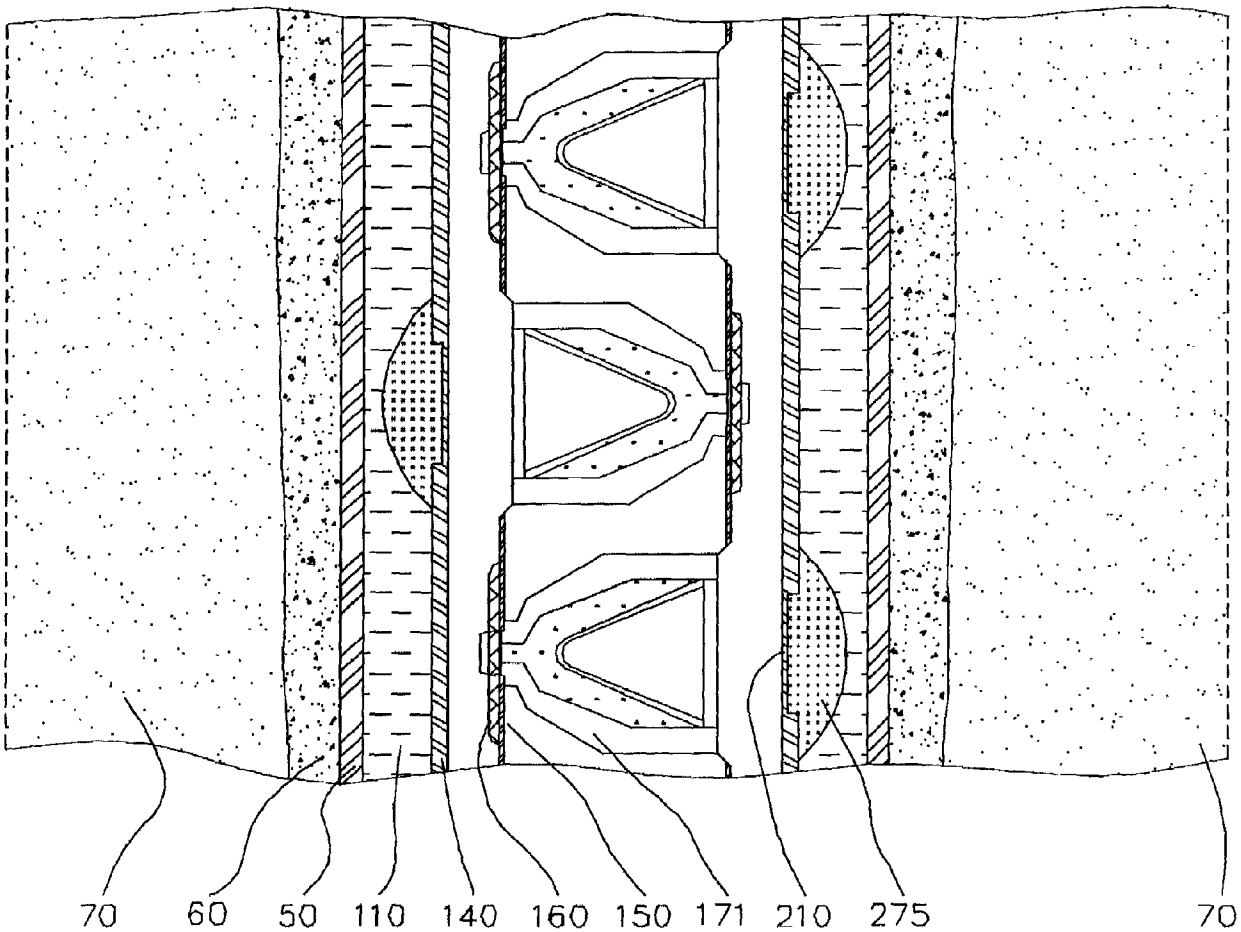
FIG. 21 shows still another embodiment to perforate and stimulate using a perforating gun and an open-end charge. Molten aluminum-producing units 275 are placed outside the gun and are ignited by the corresponding shaped charge jets. The Al—$H_2O$ reaction in the well stimulates the formation along the perforations just created by the shaped charge jets.

For a tubular perforating gun system, FIG. 21 shows another embodiment to use the present invention. In this embodiment, the molten Al to be used in the subsequent Al—$H_2O$ reaction is produced by the small units 275 placed outside the gun 140. Shown in the figure is a cross sectional view of a perforating gun with molten Al producing units 275 placed outside the gun. The shaped charges 171 can be the same as normal perforating charges manufactured in the prior art, it can also be a shaped charge of the present invention disclosed already such as that to release molten Al upon detonation or to project molten Al into a perforation. Similar to that shown in FIG. 20, charges 171 are loaded onto a charge holder 150 which is a thin steel tube, the charge holder carrying the charges are centralized in the perforating gun 140 which is positioned in a well where the hydrocarbon bearing formation 70 is to be perforated and stimulated. The charges 171 are connected to a detonating cord 160. Upon actuation, a shaped charge 171 collapses its liner to form a high velocity jet. The jet firstly penetrates through the perforating gun 140 at its weakened portion (or called scallop) 210, then ignites the reaction in the molten Al producing unit 275, flies through the well liquid 110 and then further creates a perforation through the well casing 50, concrete lining 60, into formation 70. At the same time, the molten Al producing unit 275 that has been ignited by the shaped charge jet now reacts violently to release an amount of molten Al. The temperature and weight of molten Al produced by each unit 275 are determined by the chemical composition and the size of the unit. The produced molten Al is now forced to interact with the well liquid 110, inducing the Al—$H_2O$ reaction. Then a substantial amount of thermal energy and hydrogen gas are released, and some energy will be consumed to gasify a part of the well liquid 110. The Al—$H_2O$ reaction creates a high pressure pulse in the well, forcing the gaseous material along with some well liquid to enter the perforations just created by the shaped charges 171, fracturing the crushed zone of a perforation, initializing a plurality of cracks from the perforation into the formation, greatly improving the permeability of the perforation.

The molten Al producing unit 275 uses method 1 or 2 of the present invention to produce molten Al, that is, unit 275 can be a mixture of HE/Al or oxidizer/Al in which Al is surplus in stoichiometry. The unit can be contained in a smaller container made of proper material, such as aluminum, steel, copper or brass, zinc and plastic etc. The container for unit 275 should be fluid-tight so that the well fluid will not enter the unit and the sensitivity of the mixture to jet impaction will not be changed when in the well. The units 275 are attached to the perforating gun 140 using proper means, such as threads, glue or glue tape etc. The initiation mechanism of unit 275 in the present invention is similar to that of the rocket propellant sleeve in U.S. Pat. No. 5,775,426 to Snider et al., it primarily relates to the shaped charge jet impaction, then the high temperature, high pressure detonation products venting through the hole created by the jet on the scallop 210 may also assist the ignition. However, the reaction process of unit 275 in the present invention will be more reliable and stable than the rocket propellant sleeve used in the referenced patent. If unit 275 uses a detonable mixture like HE/Al, a detonation occurs and the reaction is completed and molten Al released instantly; for a combustible mixture like an Al/metal oxide, a combustion is actuated and the process is stable due to a temperature of reaction products higher than most of the propellant combustion temperature. As is known in the art, when Al is involved in the composition of an energetic material, the reaction temperature is high and the process is stable. As a matter of fact, sometimes Al is intentionally added to the composition of a propellant in the purpose to stabilize the combustion process, such as that used in U.S. Pat. No. 4,064,935 to Mohaupt, H. H. In the present invention, for a mixture to produce Al in molten state, the temperature of the reaction products decreases as the Al content in the mixture increases beyond the stoichiometry point. Therefore, in determining the Al percentage for a mixture in a design, the temperature of the reaction products along with the surplus Al should be considered so that the reaction process is stable and reliable. Compared to the use of rocket propellant sleeve in U.S. Pat. No. 5,775,426, the volume or weight of unit 275 can be substantially smaller. This is due to the fact that the Al—$H_2O$ reaction has a much higher thermal value than the commonly used high explosives and propellant. Refer to EQ1 in FIG. 1, 1 gram of Al reacting with $H_2O$ will release about 17.5 KJ of thermal energy. Compared to the heat value of the commonly seen propellants, which is normally in the range of 4~6 KJ/per gram. Furthermore, in the Al—$H_2O$ reaction, one half of the reactants—$H_2O$, need not to be carried by the perforating gun, it is already in the well.

With the capsule type system in class 3 and the tubular perforating gun method shown in FIG. 21 (molten aluminum produced outside gun), the efficiency of utilizing the Al—$H_2O$ reaction to stimulate a formation will be better than the tubular perforating gun method shown in FIG. 20 (molten aluminum produced inside gun). This is because with the capsule type charge or the system shown in FIG. 21, the produced aluminum in molten state is forced to interact with water directly as soon as the molten Al is released. While with a tubular perforating gun shown in FIG. 20 when molten aluminum is produced inside the gun, Al in molten state is forced to escape from the small holes created by the shaped charge jets along with the detonation products. Unavoidably, there will be a significant amount of molten Al remained in the gun chamber and cannot contribute to the Al—$H_2O$ reaction which happens outside the gun chamber. With the system shown in FIG. 20, it is possible at some point when the Al—$H_2O$ reaction outside the gun builds up a pressure higher than that in the gun chamber, well fluid will be forced to enter the gun chamber through the holes in the gun created by the shaped charge jets, reacting with Al still in molten state there, which in turn will raise the pressure in the gun chamber and force some material to escape into the well. Such a material exchange between the gun chamber and the well may happen a couple of times after the detonation of the charges in the gun with less and less strength in chemical reaction. However, such a reverberation will have little help to stimulate the formation just perforated because the pressure gets lower and lower than the first time Al—$H_2O$ reaction that happens instantaneously after the perforating event. Furthermore, if the pressure increase within the gun resulted from the Al—$H_2O$ reaction that happens in the gun, it is possible to blow out the gun if the pressure is too high. Consequently, a perforating-stimulating system using the Al—$H_2O$ reaction and a tubular gun should be so designed that it can effectively complete the job but the internal pressure from the Al—$H_2O$ reaction in the gun will not break the gun.

The use of capsule type charges to perforate and stimulate as disclosed in class 3 embodiments and the tubular perforating gun system (molten Al produced outside gun) shown in FIG. 21 have certain advantages over the use of tubular perforating gun (molten Al produced inside gun) shown in FIG. 20. The capsule type charge system of class 3 uses a very simple charge carrier like a bi-wire carrier 160, compared to the tubular perforating gun 140 and charge holder 150 for the tubular gun system shown in FIG. 20. The manufacturing cost for a capsule type system in class 3 can be much lower compared to the tubular gun system. In the prior art, capsule type shaped charges are mainly used for through-tubing applications, where there are some size constraints to the charges due to the relatively small diameters of through-tubings. To maximize the benefits associated with the use of capsule type charges to perforate and stimulate using the Al—$H_2O$, charges are preferably of capsule type, even for large diameter casing applications, where traditionally open-end type charges are used with tubular perforating guns. However, the capsule charge system will leave some charge case and carrier debris in the well after the shot, this can be remedied by using a "junk basket" hanging below the capsule type charge carrier so that all the debris after the shot can be collected and recovered. For a tubular perforating gun, all the debris after the shot are contained in the perforating gun. When a tubular perforating gun is used to perforate and to stimulate, molten Al units placed outside of the gun as shown in FIG. 21 would be preferred to that shown in FIG. 20, where molten Al is produced inside the gun.

Class 5: Stimulating Method and Device

Figure 22:
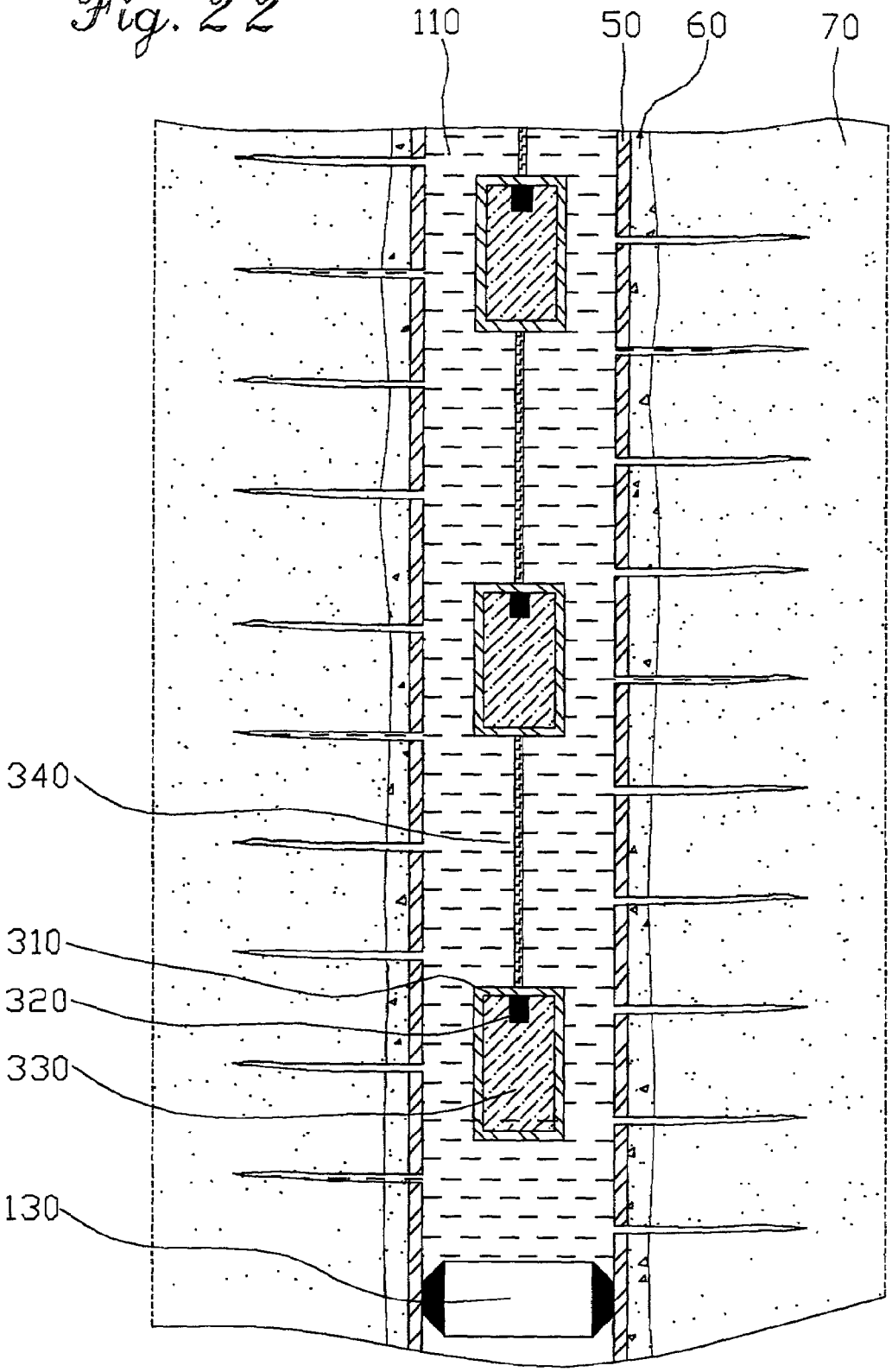
FIG. 22 shows the method and device to stimulate an already perforated formation or to revitalize an old production well. Molten Al producing devices 330 having proper initiation means 320 hang in the well liquid 110. As a result of the Al—$H_2O$ reaction in the well, formation 70 is stimulated, perforations cleaned and build-up paraffin melted and removed.

In this class of preferred embodiments of the present invention, the Al—$H_2O$ reaction is induced and used individually to stimulate a formation. This can be the stimulation of a perforated well, or the revitalization of an old production well. For some perforated wells, the hydrocarbon production rate may not be satisfactory. This may be attributed to the decreased permeability of the crushed zone in a perforation, debris remaining in the perforation, or the penetration is not deep enough. Some commonly used stimulating technologies such as acidizing the well to break down crushed zones, well flushing or hydraulic fracturing may not be very helpful. On the other hand, it has been reported that the use of propellants to be very successful (see Watson et al., Liquid Propellant Stimulation of Shallow Appalachian Basin Wells, SPE 13376, 1984). Herein disclosed is a novel method of the present invention for oil well stimulation. Shown in FIG. 22 there is a perforated zone of hydrocarbon bearing formation 70. A mixture 330 to produce aluminum in molten state is contained in a container 310. The mixture 330 can be a mixture of high explosives/aluminum or an oxidizer/aluminum, with a surplus amount of aluminum in stoichiometry in the composition. Also positioned in the container 310 is an initiator or primer 320 to detonate or to ignite the mixture. The process to produce aluminum in molten state has been described previously. Shown in the figure there are three such containers submerged in the well fluid connected by a hanging means 340. The reaction of the mixture 330 in the container can be started by using an electrical signal. The container 310 can be made of any proper material such as steel, plastic or aluminum and aluminum is preferred because it can be involved in the Al—$H_2O$ reaction. Upon initiation of the reaction in the container, the container is fractured by detonation or is heated to a very high temperature and then is fractured. The energetic Al—$H_2O$ reaction happens when the molten aluminum produced by the chemical reaction in the container is forced to interact with water 110 in the well. A packer 130 is used to isolate zone 70 being treated from other zones. Another packer can be used on top of the zone, or a liquid column can be used on top of the well liquid 110 shown in the figure. The well liquid can be water or mainly water in chemical composition; it can also be water solution of an oxygen-rich reagent such as ammonium nitrate to enhance the reactivity when it is necessary. The large quantity of gas generated and the heat released from the Al—$H_2O$ reaction creates a high-pressure pulse in the well. The pressure fractures the crushed zone and develops multiple fractures from the perforations 300. Then the stimulation process is completed just like using propellants.

When a perforated well has been in production for some time, the perforations may become clogged due to the build-up of paraffin. Then the production rate decreases and the well needs to be revitalized by removing the paraffin from the perforations. One common method in the art is to bum some propellants in the well, and then paraffin is melted by the heat released and removed by the high pressure. As noted previously, the combustion of one gram of aluminum in water generates nearly 17.5 KJ of heat, which is 3 or 4 times more than that released by the reaction of 1 gram of high explosives or propel lants. In addition to the high pressure impulse generated upon the actuation of the devices shown in FIG. 22, there is a substantial increase in the temperature of the well liquid 110. This temperature rise can be higher than the melting point of paraffin, causing it to melt and be removed from the perforations. As a result, the perforations are cleaned and the productivity of a well is increased.

Class 6: Other Engineering Applications

In addition to oil well uses as embodied in classes 1~5, the present invention can also be used in numerous other industries where an energetic material should be used. As mentioned previously, aluminum has been used to make "aluminized" explosives in the art of explosive manufacturing, but the aluminum content in the mixture is kept below the stoichiometry point. Therefore, no surplus aluminum in molten state is produced by the detonation of "aluminized" explosives. So it is not possible to utilize the Al—$H_2O$ reaction and in fact it is not the intent of using "aluminized" explosives in engineering practice.

Figure 23:
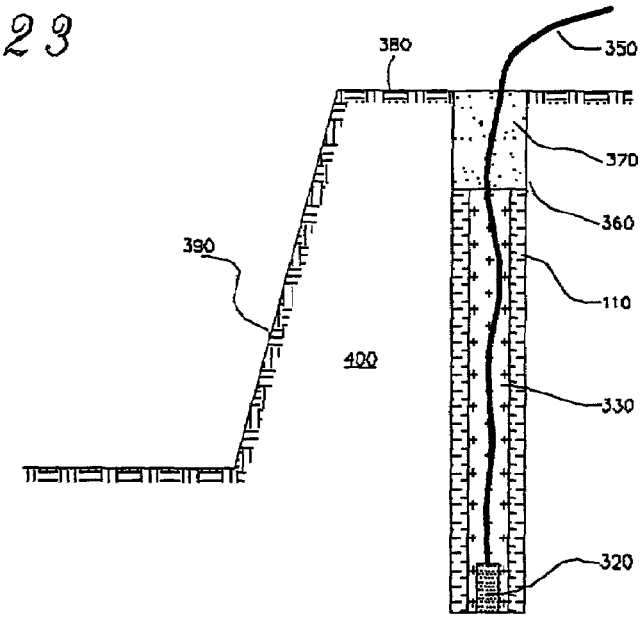
FIG. 23 shows an embodiment to create a dual-explosion in rock blasting. Explosive 330 is a detonable mixture that produces molten Al. An initiation means 350 and a boost charge 320 are used to detonate 330. The Al—$H_2O$ reaction enhances the mechanical effects in the rock stratum 400 created by the detonation of charge 330.

An explosive mixture that can output molten aluminum upon detonation of the mixture to induce an Al—$H_2O$ reaction is particularly useful for some applications where a secondary explosion event is needed to enhance the mechanical effects created by the primary detonation of the said explosive mixture. In FIG. 23, there is shown an example of the explosive of the present invention in rock blasting. In the figure, a drilled hole 360 in rock stratum 400, an explosive charge 330 of the present invention which is a mixture of an explosive with a surplus amount of aluminum powder in stoichiometry, at the bottom of the charge 330 is a detonation initiator which is a detonator or a detonator with a primer charge, connecting the detonation initiator 320 to the ground surface is a initiation energy transmitting means 350 which can be electric wires, a detonating cord or non-electric plastic shock tube or other appropriate means to transmit initiation energy, water 110 in the well and stemming material 370 on top of the drillhole 360. When the charge 330 is detonated, the shock wave is transmitted through the water medium 110 into the rock stratum 400. The rock stratum breaks into fragments along the free faces 380 and 390. Upon detonation of the charge 330, surplus aluminum is produced in the drillhole 360 and is dispersed into water 110, forced to react with water and to create another explosion event in the drillhole 360. Then a large amount of hydrogen gas and heat is released and the energy is imparted into the rock stratum 400 just fractured by the detonation of the charge 330. The rock stratum is further fractured into smaller pieces and moved forward for a desired distance and to form a muck pile of desired shape.

Figure 24:
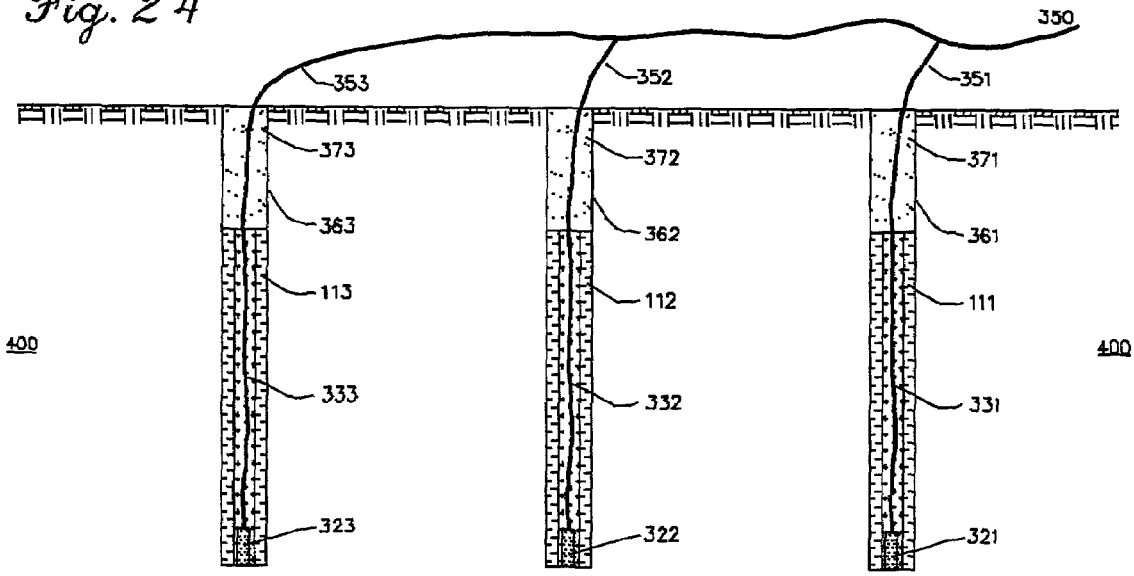
FIG. 24 shows an embodiment to create a dual-explosion in rock splitting. The purpose of this design is to split the rock stratum 400 along a line of the drillholes 361, 362 and 363. Explosives 331, 332 and 333 are initiated simultaneously and the Al—$H_2O$ reaction within the holes develops and widens the crack created by the primary detonation.

In FIG. 24, there is shown another application of the present invention in rock blasting. Unlike that shown in the previous figure, the purpose of this application is not to fracture the rock material into small pieces. Instead, it is to split the rock stratum 400 along the drillholes 361, 362, 363 (shown 3 drillholes in the figure, in practical applications, the number of holes can be much greater drilled along a line to split the rock). Such applications are quite common in mining and civil engineering where rock excavation is involved. Such as the construction of hydraulic power station, tunneling, demolition of concrete structure etc. where the rock or other medium need to be neatly cut to form a desired profile. In the figure, there are aluminum-producing charges 331, 332 and 333, detonation initiators 321, 322 and 323, water columns in the well 111, 112 and 113, stemming materials on top of the charges 371, 372 and 373, and initiating energy transmitting means 351, 352, 353 connected to 350, which are normally a detonating cord for simultaneity in detonation initiation. The amount of explosives used can be calculated so that they just create a crack between adjacent holes but does not fracture the rock. In the figure shown, upon detonation of the charges 331, 332 and 333, cracks are created between the drillholes 361 and 362, and between 362 and 363, the subsequent Al—$H_2O$ reaction that happens in the drillholes will widen and extend the cracks by the detonation event of the charges. The energy released from the secondary reaction can be a few times more than that from the detonation of the charges. As a result, the amount of explosives used per square meter of cracks created can be significantly lower than with the use of conventional explosives; or due to the great amount of gas and energy released, the distance between the drillholes can be significantly increased so that the total drilling cost for a project can be reduced.

In the applications described above and illustrated by FIGS. 23 and 24, water 110, 111, 112 and 113 in the drillholes 360, 361, 362 and 363, respectively can also be a water solution of some oxidizers such as ammonium nitrate ($NH_4NO_3$) to increase the chemical reactivity with aluminum. If a water-soluble oxidizer is used in water, it is possible that the hydrogen gas ($H_2$) released from the Al—$H_2O$ reation will further react with the said oxidizer to form water again and to contribute even more energy to the blasting process. The presence of water in the drillhole is a prerequisite to use the Al—$H_2O$ reaction and to create the secondary explosive event. If the drillhole has cracks and cannot hold water, or when the hole is drilled not perpendicular to the ground surface but horizontally or inclined, the water columns 110, 111, 112 and 113 as shown in the figures can be replaced by alternative means, such as the use of water contained in plastic bags.

Explosive devices made using the present invention can also be used in in-situ coal gasification. U.S. Pat. No. 4,109,719 to Martin et al. discloses a method to gasify in situ coal that involves the use of explosives to improve the permeability of coal seams to be gasified. A mixture of an explosive (or an oxidizer) with a surplus amount of aluminum in stoichiometry of the present invention used in presence of water would be particularly suitable for this kind of applications. The Al—$H_2O$ reaction releases much more energy than conventional explosives. When used for in situ coal gasification, this part of energy along with the great amount of gas generated would significantly improve the permeability of a coal seam being treated. Similarly, a water solution of oxidizer can be used in place of plain water to increase its reactivity with aluminum.

In another embodiment, the present invention concerns itself about the design of an explosive device used in the defense industry, such as a torpedo to be used underwater. According to the present invention, such an explosive device can be designed to create a "dual explosion" by using an HE/Al mixture as explosive load in which Al is surplus in stoichiometry. The high explosive can be any commonly used military explosive such as RDX, HMX, PETN or TNT etc. The first of the said "dual explosion" is the detonation of the said HE/Al mixture and the second being the Al—$H_2O$ reaction. As described previously in the present invention, for such a "dual explosion" event, the second explosion can release much more energy than the first one. When this concept of the present invention is used in the design of an explosive device like a torpedo, to achieve the same energy level the payload of the device that needs to be launched and propelled toward a target can be significantly reduced. With its huge amount of energy release and hydrogen gas generated, the said second explosion will greatly enhance the mechanical effects created by the first explosion in the target. Additionally, similar to the shaped charge designs as described in the class 1 application embodiments, a torpedo can also have a shaped charge capable of projecting molten Al into a perforation created by the first explosion in the target and then inducing an Al—$H_2O$ explosion locally within the target, further piercing and fracturing the target that has been penetrated by the said first explosion.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

REFERENCES REFERRED TO IN SPECIFICATION

A. U.S. patents

1. U.S. Pat. No. 3,747,679, L. N. Roberts, Method of Fracturing a Formation Using A Liquid Explosive, Jul. 24, 1973
2. U.S. Pat. No. 3,797,391, Cammarata et al., Multiple Charge Incendiary Bomlet, Mar. 19, 1974
3. U.S. Pat. No. 4,064,935, H. H. Mohaupt, Oil Well Stimulation Apparatus, Dec. 27, 1977
4. U.S. Pat. No. 4,081,031, H. H. Mohaupt, Oil Well stimulation Method, Sep. 13, 1976
5. U.S. Pat. No. 4,109,719, W. L. Martin and H. A. Wahl, Method for Crating a Permeable Fragmented Zone within A Subterranean Carbonaceous Deposit for In Situ Coal Gasification, Aug. 29, 1978
6. U.S. Pat. No. 4,253,523 to Isben discloses
7. U.S. Pat. No. 4,280,409, Rozner A. G. and Helms H. H., Molten metal-liquid explosive device, Jul. 28, 1981
8. U.S. Pat. No. 4,372,213, Rozner A. G. and Helms H. H., Molten metal-liquid explosive method, Feb. 8, 1983
9. U.S. Pat. No. 4,376,083, K. Ulsteen, Process for the preparation of aluminum-containing high-energy explosives compositions, Mar. 3, 1983
10. U.S. Pat. No. 4,391,337, F. C. Ford, G. A. Hill, C. T. Vincent, High-velocity jet and propellant fracture device for gas and oil well production, Jul. 5, 1983
11. U.S. Pat. No. 4,498,367, S. Skolnick and A. Goodman, Energy trasfer through a multi-layer liner for shaped charges, Feb. 12, 1985
12. U.S. Pat. No. 4,683,951, Pathak et al., Chemical flooding and controlled pressure pulse fracturing process for enhanced hydrocarbon recovery from subterranean formations, Aug. 4, 1987
13. U.S. Pat. No. 4,739,832, A. R. Jennings, Jr. and L. G. Jones, Method for Improving High Impulse Fracturing, Apr. 26, 1988
14. U.S. Pat. No. 4,784,061, G. B. Christopher, Capsule Charge Locking Device, Nov. 15, 1988
15. U.S. Pat. No. 4,817,531, G. B. Christopher, Capsule Charge Retaining Device, Apr. 4, 1989
16. U.S. Pat. No. 5,083,615, E. McLaughlin; F. C. Knopf, Aluminum Alkyls Used to Create Multiple Fractures, Jan. 28, 1992

17. U.S. Pat. No. 5,052,272, W. W. Lee, Launching Projectiles with Hydrogen Gas Generated from Aluminum Fuel Powder/Water Reaction, Oct. 1, 1991
18. U.S. Pat. No. 5,355,802, L. Petitjean, Method and Apparatus for Perforating and Fracturing in a Borehole, Oct. 18, 1994
19. U.S. Pat. No. 5,551,344, B. Couet et al., Method and apparatus for overbalanced perforating and fracturing in a borehole, Sep. 3, 1996
20. U.S. Pat. No. 5,690,171, P. C. Winch et al., Wellbore Stimulation and Completion, Nov. 25, 1997
21. U.S. Pat. No. 5,712,442, W. W. Lee and R. D. Ford, Method for Launching Projectiles with Hydrogen Gas, Jan. 27, 1998
22. U.S. Pat. No. 5,775,426, P. M. Snider et al., Apparatus and Method for Perforating and Stimulating a Subterranean Formation, Jul. 7, 1998
23. U.S. Pat. No. 5,789,696, P. M. Snider et al., Apparatus and Method for Perforating and Stimulating a Subterranean Formation, Aug. 4, 1998
24. U.S. Pat. No. 5,859,383, Davison et al., Electrically activated, metal fueled explosive device, Jan. 12, 1999
25. U.S. Pat. No. 6,012,392, K. J. Norman and D. W. Pratt, Shaped Charge Liner and Method of Manufacture, Jan. 11, 2000
26. U.S. Pat. No. 6,142,056, R. P. Taleyarkhan, Variable Thrust Cartridge, Nov. 7, 2000

B. Publications

1. Curtis, J. P. and Cornish, R., Formation model for shaped charge liners comprising multiple layers of different materials, 18th International Symposium on Ballistics, San Antonio, Tex., Nov. 15-19, 1999
2. Delacour, J., Lebourg, M. P., Bell, W. T., A new approach toward eliminating of Slug in Shaped Charge Perforating, Journal of Petroleum Technology, March, 1958
3. Davis, T. L., The Chemistry of Powder and Explosives, Complete in one Volume, page 499, first printed 1943
4. Davison D. & Johnson R., Metafex composites: safe, energetic, economical replacements for explosives, 25th Annual Conference on Explosives and Blasting Techniques, Nashville, Tenn. USA, February 1999
5. Lee, W. M., Metal/water chemical reaction coupled to a pulsed electrical discharge, pp. 6945~6951, J. Appl. Phy. 69(10), May 15, 1991
6. Lubyatinsky, S. N., Loboiko, B. G., Reaction Zone Measurements in Detonating Aluminized Explosives, pp. 779~782, Proceedings of the Conference of the American Physical Society Topical Group on Shock Compression of Condensed Matter held at Seattle, Wash., Aug. 13-18, 1995
7. Mansfield D., Researchers Develop Way to Vary Bullet's Speed, The Associated Press, CNEWS, Science, Jul. 20, 1999
8. Martinez M. J., The Non-Lethal Bullet, Researchers Creating Adjustable Firearms, ABCNEWS.com, Jun. 17, 1999
9. Miller, K. K. SPE, and Prosceno, R. J., SPE, Marathon Oil Co.; R. A. Woodroof, Jr., SPE, ProTechnics; and R. L. Haney, HTH Technical Services, Inc., SPE 39779, Permian Basin Field Tests Of Propellant-Assisted Perforating, 1998 SPE Permian Basin Oil and Gas Recovery Conference held in Midland, Tex., Mar. 25-27, 1998
10. ORNL devises way to prevent steam explosions, ORNL (Oak Ridge National Laboratory) News Release, Aug. 8, 1997.
11. Rightly, M. J. Beck, D. F. and Berman M., "NPR/FCI EXO-FITS experiment series report," Sandia National Laboratory Report No. SAND 91-1544, January, 1993
12. Rinehart, J. S. and Cocanower, R. D., Concerning the Design of an Effective Shaped Charge for Oil Well Perforator, Journal of Applied Physics, Volume 30, number 5, May, 1959
13. Seymour Z. Lewin, "Aluminum," Microsoft Encarta 98 Encyclopedia, 1993-1997 Microsoft Corporation.
14. Stoller, H. M., A Perspective on Tailored Pulse Loading: A New Approach to Oil and Gas Well Stimulation, paper SPE 13860, 1985
15. Subramanian, V. S. and Thadhani, N. N., Reaction Behaviour of Shock Compressed Aluminum and Iron-Oxide Powder Mixtures, Shock Compression of Condensed Matter—1995, Proceedings of the Conference of the American Physical Society Topical Group on Shock Compression of Condensed Matter held at Seattle, Wash., Aug. 13-18, 1995, page. 681~684
16. Theofanous, T. G. et al., Ignition of aluminum droplets behind shock waves in water, Phys. Fluids 6 (11), November, 1994
17. Todd B. J. et al, Perforation Geometry and Skin Effects on Well Productivity, SPE 15029

Watson, S. C. et al., Liquid Propellant Stimulation: Case Studies in Shallow Appalachian Basin Wells, May 1986, Society of Petroleum Engineers, SPE 13776

I claim:

1. A method to utilize the energy released by the molten aluminum-water reaction to do useful work by creating a dual explosion in a medium to which desired mechanical effects are to be created comprising the following steps:

a) placing in the presence of water a detonable or combustible explosive device in the said medium, the said explosive device being capable of converting aluminum powder to aluminum in its molten state to react with water; and, b) actuating the said explosive device to initiate the first of the said dual-explosion which is a detonation or combustion of the said explosive device, creating mechanical effects in the said medium and releasing aluminum in its molten state, wherein the molten aluminum then reacts with water to create a second explosion of the said dual-explosion, enhancing or modifying the mechanical effects created by the said first explosion.

2. The method of claim 1 wherein the said medium to which the desired mechanical effects are to be created is one chosen from the group consisting of: water, rock stratum, concrete, steel casing in an oil well, steel tubing in an oil well, steel casing in a gas well, steel casing in an oil well, hydrocarbon bearing formation, coal seam, and a target of any material to be attacked.

3. The method of claim 1 wherein the said mechanical effects in the said medium are the mechanical effects for which an explosive device is designed to achieve is one or a combination chosen from the group of effects consisting of:

pressure wave generation, pressure wave propagation, pressurization of medium, displacement of medium, target penetration, target piercing, target fracturing, crack initialization, crack propagation, medium disintegration, medium fragmentation and fragment movement.

4. A method to utilize the energy released by a molten-metal water reaction to do useful work by creating a dual explosion in a medium to which desired mechanical effects are to be created comprising the following steps:

a) placing, in the presence of water, a detonable or combustible explosive device in the said media, the said explosive device being capable of producing a light metal or its alloy which has a tendency to react with water in its molten state and release a substantial amount of thermal energy and hydrogen gas from the reaction, such light metal being one chosen from the group consisting of: magnesium, aluminum-magnesium alloy, aluminum-lithium alloy, zirconium, and mixtures thereof; and b) actuating said explosive device to initiate the first of the said dual explosion which is a detonation or combustion of the explosive device, creating mechanical effects in the said medium in releasig said light metal or its alloy in its molten state, wherein the molten light metal or said alloy then reacts with water to create a second explosion of the said dual-explosion, enhancing or modifying the mechanical effects created by the said first explosion.

5. The method of claim 4 wherein the said medium to which the desired mechanical effects are to be created is one chosen from the group consisting of: water, rock stratum, concrete, steel easing in an oil well, steel tubing in an oil well, steel casing in a gas well, steel casing in an oil well, hydrocarbon bearing formation, coal seam, and a target of any material to be attacked.

6. The method of claim 4 wherein the said mechanical effects in the said medium are the mechanical effects for which an explosive device is designed to achieve is one or a combination chosen from the group of effects consisting of: pressure wave generation, pressure wave propagation, pressurization of medium, displacement of medium, target penetration, target piercing, target fracturing, crack initialization, crack propagation, medium disintegration, medium fragmentation and fragment movement.

* * * * *

UNITED STATES PATENT AND TRADEMARK OFFICE

CERTIFICATE OF CORRECTION

PATENT NO. : 7,393,423 B2
APPLICATION NO. : 09/923368
DATED : July 1, 2008
INVENTOR(S) : Liu Liqing It is certified that error appears in the above-identified patent and that said Letters Patent is hereby corrected as shown below:

In the Claims:
Col. 44 in Claim 5, line 4, please delete “easing” and insert --casing-- therefore.

Signed and Sealed this

Ninth Day of September, 2008

JON W. DUDAS
*Director of the United States Patent and Trademark Office*